US007351509B2

(12) United States Patent
Moribe et al.

(10) Patent No.: US 7,351,509 B2
(45) Date of Patent: Apr. 1, 2008

(54) TONER

(75) Inventors: Shuhei Moribe, Shizuoka (JP); Nobuyuki Okubo, Shizuoka (JP); Tsutomu Onuma, Kanagawa (JP); Shinichiro Abe, Ibaraki (JP); Koji Nishikawa, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 355 days.

(21) Appl. No.: 11/013,534

(22) Filed: Dec. 17, 2004

(65) Prior Publication Data

US 2005/0186497 A1 Aug. 25, 2005

(30) Foreign Application Priority Data

Feb. 20, 2004 (JP) ..... 2004-043956

(51) Int. Cl.
*G03G 9/08* (2006.01)

(52) U.S. Cl. ..... 430/108.8; 430/109.3; 430/110.1

(58) Field of Classification Search ..... 430/109.3, 430/108.8, 110.1
See application file for complete search history.

(56) References Cited

U.S. PATENT DOCUMENTS

| | | | | |
|---|---|---|---|---|
| 5,342,722 | A | 8/1994 | Ito et al. | 430/109 |
| 5,370,958 | A | 12/1994 | Shin et al. | 430/110 |
| 5,489,498 | A | 2/1996 | Ohno et al. | 430/110 |
| 5,605,778 | A | 2/1997 | Onuma et al. | 430/110 |
| 5,744,276 | A | 4/1998 | Ohno et al. | 430/109 |
| 5,753,397 | A | 5/1998 | Nakayama | 430/108.4 |
| 5,854,365 | A | 12/1998 | Ohno et al. | 526/228 |
| 5,858,598 | A | 1/1999 | Nakayama | 430/109.4 |
| 5,942,366 | A | 8/1999 | Ohno et al. | 430/125 |
| 5,968,701 | A | 10/1999 | Onuma et al. | 430/110 |
| 5,998,080 | A | 12/1999 | Ohno et al. | 430/108.4 |
| 6,194,113 | B1 | 2/2001 | Okutani | 430/109.2 |
| 6,426,169 | B1 | 7/2002 | Onuma et al. | 430/108.23 |
| 6,458,499 | B1 | 10/2002 | Onuma et al. | 430/108.4 |
| 6,881,527 | B2 * | 4/2005 | Moribe et al. | 430/109.4 |
| 2002/0034702 | A1 * | 3/2002 | Onuma et al. | 430/108.4 |
| 2002/0098434 | A1 | 7/2002 | Anno et al. | 430/108.8 |
| 2003/0129517 | A1 * | 7/2003 | Hotta et al. | 430/108.22 |
| 2003/0134216 | A1 | 7/2003 | Kawanishi et al. | 430/108.8 |
| 2003/0198883 | A1 | 10/2003 | Hiratsuka et al. | 430/109.3 |

FOREIGN PATENT DOCUMENTS

| | | |
|---|---|---|
| JP | 57-208559 | 12/1982 |
| JP | 09-6050 | 1/1997 |
| JP | 10-087837 | 4/1998 |
| JP | 2962809 | 8/1999 |
| JP | 3118341 | 10/2000 |

* cited by examiner

*Primary Examiner*—John L Goodrow
(74) *Attorney, Agent, or Firm*—Fitzpatrick, Cella, Harper & Scinto

(57) ABSTRACT

A toner is disclosed including toner particles containing a binder resin and a colorant. The binder resin contains a vinyl resin. In the high-temperature GPC-RALLS-viscometer analysis of the o-dichlorobenzene-soluble matter of the toner, a weight-average molecular weigh of absolute molecular weights measured with a viscosity detector is in a specific range. In the o-dichlorobenzene-soluble matter, a component with the absolute molecular weight of 10,000 or less and a component with the absolute molecular weight of 1,000,000 or more are present in specific proportions, respectively. The intrinsic viscosity of the toner is in a specific range.

7 Claims, 3 Drawing Sheets

TONER

BACKGROUND OF THE INVENTION

1. Field of the Invention

This invention relates to a toner used in image forming processes such as electrophotography, electrostatic recording, magnetic recording and toner jet recording.

2. Related Background Art

In electrophotography, conventionally using photoconductive materials, an electrostatic latent image is formed on a photosensitive member by various means, subsequently developed by the use of a toner to form a toner image, and the toner image is transferred to a transfer material such as paper as needed, followed by fixing by the action of heat, pressure, heat-and-pressure or solvent vapor to form a fixed image.

As a method for fixing the toner image to a sheet such as paper, which is the above final step, the most commonly available method at present is a pressure-and-heating system making use of a heat roller. According to this method, the surface of the heat roller and the toner image on the fixing-receiving sheet (sheet to which toner images are to be fixed) come into contact with each other under application of pressure, and hence the thermal efficiency in fusing the toner image onto the fixing-medium sheet is so good that the toner image can rapidly be fixed.

However, since the heat roller surface and the toner image come into contact with each other under application of pressure, there is a problem of high-temperature offset such that part of the toner image may adhere, and be transferred, to the fixing roller surface, and transferred again to the next fixing-receiving sheet to cause an offset phenomenon to contaminate the fixing-receiving sheet.

There are also increasing sever demands on fixed images in order to adapt the higher speed of apparatus, more energy saving and shorter wait time, and further to deal with the folding of fixed images, the release of a pressure-sensitive adhesive tape from fixed images, and so forth. The low-temperature fixing performance is desired to be further improved, but when improving the low-temperature fixing performance, problems are raised such that the mechanical strength of toner is apt to lower, and development durability tends to lower and cause problems such as adhesion (melt adhesion) of toner to developer carrying members and melt adhesion of toner to photosensitive members.

Accordingly, toner is required to have superior low-temperature fixing performance and high-temperature anti-offset properties, and also to have superior development durability and cause no toner adhesion (melt adhesion) to the above members (developer carrying members and photosensitive members).

Heretofore, as resins for toners, vinyl copolymers (such as styrene resins) and polyester resins have been primarily used.

The polyester resins, though having high glass transition temperature, can readily provide resins having low-softening point and, when heated and melted, show so good ability to wet fixing-receiving sheets such as paper that good fixing can be performed at lower temperature. However, on the other hand, they have the disadvantage of causing the offset phenomenon at a high temperature. Hence, it is necessary to use release agents having a variety of release properties at the time of high-temperature fixing.

For example, Japanese Patent Application Laid-open No. S57-208559 discloses a toner containing a polyester resin as a binder resin. There, however, is room for improvement in fluidity and agglomeration resistance which are powder characteristics required for toners. Also, the polyester resin is difficult to pulverize in a process involving the pulverization step and is disadvantageous in respect of productivity.

On the other hand, resins having superior releasability at high temperature include vinyl resins. The vinyl resins have such properties that the temperature at which the melt viscosity begins to lower is relatively high and high releasability can be easily obtained, but have a relatively high melt starting temperature. However, the molecular weight of the binder resin in its molecular weight distribution is reduced in an attempt to lower the temperature at which the melt viscosity begins to lower, with the result that necessary release effect is not obtained. Even if a release agent is used with vinyl resins having reduced molecular weight in order to achieve low-temperature fixing, the melted resins themselves have so low viscosity as to make it difficult to obtain the necessary release effect.

A toner is also proposed which makes use of a resin obtained by polymerizing a vinyl monomer in the presence of a reactive polyester resin and increasing the molecular weight of the polymer through cross-linking reaction, addition reaction and grafting reaction in the course of polymerization. Further, in Japanese Patent No. 2962809, a resin composition for toner is proposed which is composed of a copolymer of a polyester resin and a vinyl monomer and a polyester resin.

Toners containing the vinyl polymer or gel matter obtained by such cross-linking reaction may be improved in anti-offset performance. However, where the vinyl polymer obtained by such cross-linking reaction is used as a toner raw material, the polymer undergoes larger shear force depending on the height of viscoelasticity at the time of melt kneading in producing toner particles, and so, the cutting of polymer molecular chains is accelerated to lower the melt viscosity of the binder resin, so that the anti-offset performance of the toner at the time of fixing deteriorates. Also, the cutting of polymer molecular chains may generate heat to cause the temperature rise of the polymer itself at the time of melt kneading, thereby raising such a problem that it is unable to achieve the sufficient dispersion state of the components contained in the toner particles.

It is also known to control molecular weight distribution. For example, in Japanese Patent Application Laid-open No. H10-87837 and Japanese Patent No. 3118341, toners are proposed in which molecular weight distribution controlled to have peaks separated into two regions of low molecular weight and high molecular weight is formed and which have as a binder resin a resin composition constituted of a carboxyl-group-containing vinyl resin, using as a cross-linking agent a glycidyl-group-containing vinyl resin.

These toners exhibit superior effects on the improvement in anti-offset properties. However, there remains room for further improvement in low-temperature fixing performance and high-temperature anti-offset properties when used in a system of high process speed or when applied to simplify a fixing assembly or to achieve energy saving. In addition, when using such a cross-linked resin, the resin has high viscosity to cause coarse particles in producing toner particles. As a result, the toner tends to bring about faulty images due to sleeve coat non-uniformity, which is remarkable especially in a high-speed development system.

In Japanese Patent Application Laid-open No. H09-6050, a toner is proposed in which the ratio of weight-average molecular weight measured by a light scattering method to weight-average molecular weight measured by GPC is specified. However, when this toner is used especially in a high-speed development system, there remains room for further improvement in high-temperature anti-offset properties.

Thus, under existing circumstances, there is no toner which can satisfactorily achieve all the space saving, high speed and energy saving.

SUMMARY OF THE INVENTION

As discussed above, according to the present invention, a toner having solved the above problems can be provided.

That is, an object of the present invention is to provide a toner having superior development durability, low-temperature fixing performance and high-temperature anti-offset properties even in a high-speed development system.

Another object of the present invention is to provide a toner prevented from causing adhesion (melt adhesion) of toner to developer carrying members and melt adhesion of toner to photosensitive members even in a high-speed development system, and also from causing spots around line images and ghost.

The present invention provides a toner comprising toner particles containing at least a binder resin and a colorant, wherein the binder resin contains a vinyl resin;

a weight-average molecular weight (Mw) of absolute molecular weights measured with a viscosity detector in high-temperature GPC-RALLS-viscometer analysis of o-dichlorobenzene-soluble matter of the toner is from $1.0\times10^3$ to $1\times10^5$;

in the o-dichlorobenzene-soluble matter, a component having the absolute molecular weight of 10,000 or less is in a proportion of from 40% by weight to 90% by weight, and a component having the absolute molecular weight of 1,000,000 or more is less than 10% by weight; and the toner has an intrinsic viscosity of from 0.10 ml/g to 0.80 ml/g as measured with the viscosity detector.

DESCRIPTION OF THE PREFERRED EMBODIMENTS

Figure 1:
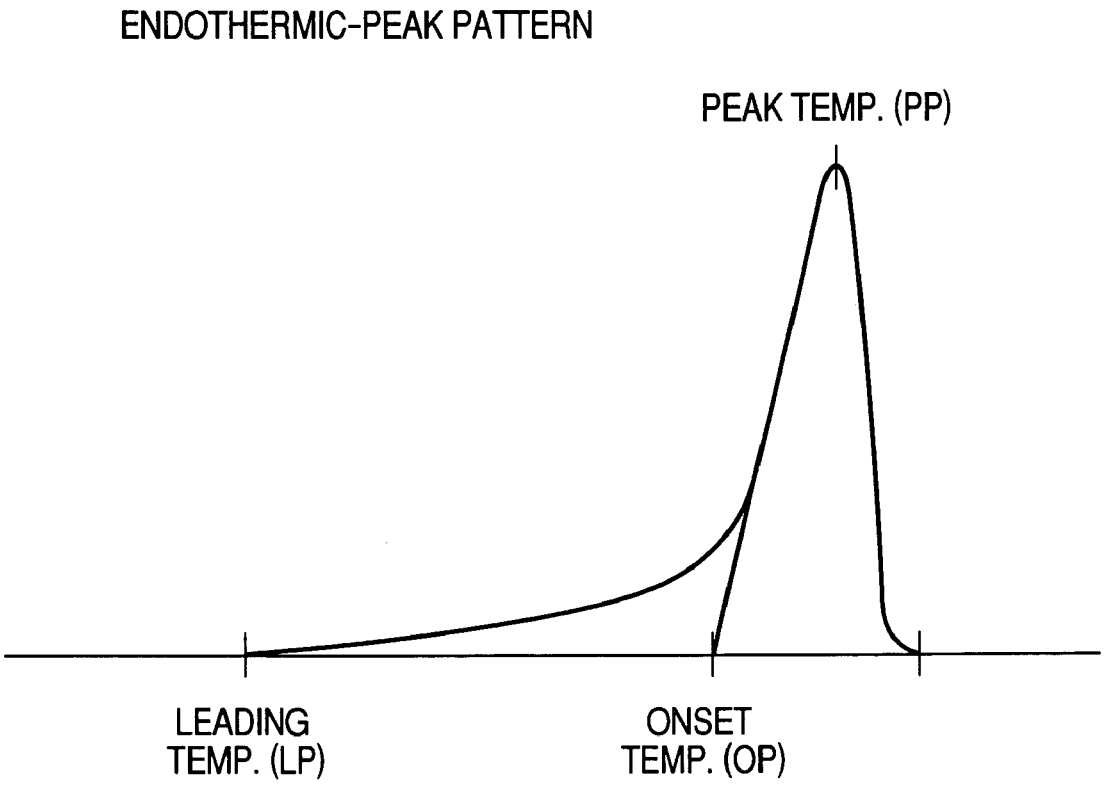
FIG. 1 is a graph showing an endothermic peak pattern of a DSC curve at the time of heating.

Styrene resins, though promising superior development durability, have relatively high melt starting temperature, and hence have made toners have inferior low-temperature fixing performance especially in a high-speed development system. In order to compensate such a drawback, a method has been employed in which the molecular weight distribution of a binder resin is brought to the lower molecular weight side to lower the temperature at which the melt viscosity begins to lower, or a method in which a release agent is used in a styrene resin having low-molecular weight. However, the resin has so high viscosity that it has been difficult to obtain the necessary release effect.

Accordingly, the present inventors have made studies, and as a result, they have discovered that the problems discussed above can be solved when, in order to attain superior low-temperature fixing performance, high-temperature anti-offset properties and development durability in using styrene resins, the toner includes toner particles containing at least a styrene resin and a colorant, wherein o-dichlorobenzene-soluble matter (hereinafter referred to also as "ODCB") of the toner has a weight-average molecular weight (Mw) of from $1.0\times10^3$ to $1\times10^5$ of absolute molecular weights measured with a viscosity detector in a high-temperature GPC-RALLS-viscometer analysis of the o-dichlorobenzene-soluble matter; in the o-dichlorobenzene-soluble matter, a component having the absolute molecular weight of 10,000 or less is in a proportion of from 40 to 90% by weight, and a component having the absolute molecular weight of 1,000,000 or more is less than 10% by weight; and the toner has an intrinsic viscosity of from 0.10 ml/g to 0.80 ml/g as measured with the viscosity detector. (GPC-RALLS: gel permeation chromatography—right angle laser light scattering)

The molecular weight distribution as measured by GPC using a THF (tetrahydrofuran) solvent, having conventionally been measured, is equivalent to conversion molecular weight based on molecular size, and does not exactly represent the molecular weight the monomer actually has. Accordingly, there have been disadvantages such that it is difficult to sufficiently correlate molecular weight with toner performance and also no information on solvent-insoluble matter is obtained.

Meanwhile, the molecular weight measured with a viscosity detector in a high-temperature GPC-RALLS-viscometer analysis of the o-dichlorobenzene(ODCB)-soluble matter is the absolute molecular weight of a polymer.

In particular, the ODCB-soluble matter, which is extracted with o-dichlorobenzene at high temperature (135° C.), also contains gel components present as ODCB-insoluble matter at normal temperature and dissolving in part, and can be said to have molecular weight distribution close to that of the whole resin inclusive of gel content. Also, the temperature 135° C. is close to fixing temperature, and hence the state of a polymer in the temperature range at the time of fixing can be measured from the viewpoints of molecular weight and viscosity. Hence, the performance of toner at the time of fixing can be directly inspected, and the present invention defines these.

The ODCB-soluble matter contained in the toner of the present invention may be grouped into a component (1) which dissolves even at normal temperature and a component (2) which does not dissolve at normal temperature, but serves as a soluble component in high-temperature ODCB.

The component (1) is a low-molecular weight component effective in fixing. On the other hand, the component (2) is a component in which high polymer molecules stand entangled and which serves as gel at normal temperature. This component has a softening point close to that of a low-molecular weight resin, and is apt to start thermal behavior even in a low-temperature region, and further is superior in solubility by heat, and hence makes melt speed higher at the time of fixing than conventional resins. Therefore, the toner can have good fixing performance even in high-speed developing assemblies. This component also has soft elasticity, and hence satisfies high-temperature anti-offset without impairing low-temperature fixing performance. It still also comes disentangled by heat and mixes readily with other components such as a magnetic material and a release agent. Hence, it can afford a toner having good developing performance as well. Also, as being different from conventional hard insoluble matter, it has no strong brittleness and can afford good pulverizability as well.

Both of such components mix with each other in an optimum state to come into a resin having especially low viscosity among styrene resins, so that the toner can have superior low-temperature fixing performance and development durability even in high-speed image forming apparatus, and also can have superior production stability.

the o-dichlorobenzene-soluble matter of the toner of the present invention has the weight-average molecular weight (Mw) of from $1.0\times10^3$ to $1\times10^5$, preferably from $5.0\times10^3$, to $5.0\times10^4$, and more preferably from $8.0\times10^3$ to $3.0\times10^4$, of the absolute molecular weights measured with a viscosity detector in a high-temperature GPC-RALLS-viscometer analysis of the o-dichlorobenzene-soluble matter. If the weight-average molecular weight (Mw) of the absolute molecular weights is less than $1.0\times10^3$, the resin has so low viscosity that the toner may have poor anti-offset properties. If on the other hand the weight-average molecular weight (Mw) of the absolute molecular weights is more than $1.0\times10^5$, the toner may have poor fixing performance.

It is also a characteristic feature that in the o-dichlorobenzene-soluble matter, the component with the absolute molecular weight of 10,000 or less is in a proportion of from 40 to 90% by weight, preferably from 45 to 80% by weight, and more preferably from 50 to 70% by weight, and the component with the absolute molecular weight of 1,000,000 or more is less than 10% by weight, preferably in a proportion of from 0 to 5% by weight, and more preferably from 0 to 2% by weight. If the component with the absolute molecular weight of 10,000 or less is in a proportion of less than 40% by weight, the quantity of the low-molecular weight component is so small that the toner may have a poor fixing performance. If it is more than 90% by weight, image density tends to decrease in running (extensive operation) because of toner melt adhesion to sleeve. If on the other hand the component with the absolute molecular weight of 1,000,000 or more is in a proportion of 10% by weight or more, the toner may have low fixing performance.

In the toner of the present invention, it is still also a characteristic feature that the toner has an intrinsic viscosity of from 0.10 ml/g to 0.80 ml/g, preferably from 0.20 ml/g to 0.60 ml/g, and more preferably from 0.30 ml/g to 0.50 ml/g, as measured with the viscosity detector. If its intrinsic viscosity is less than 0.10 ml/g, the toner may have low anti-offset properties and low fluidity, making it difficult to obtain high-quality images, especially in a high-temperature and high-humidity environment. If it is more than 0.80 ml/g, the toner may be so hard as to tend to scratch the developing sleeve.

As a more preferred embodiment of the present invention, the toner may preferably have a molecular size Rw (radius of inertia) of from 1 nm or more to less than 20 nm, and more preferably from 3 nm or more to less than 15 nm, as measured with the viscosity detector in the high-temperature GPC-RALLS-viscometer analysis of the toner.

The molecular size Rw (radius of inertia) indicates the spatiality of a molecule in question, and is greatly concerned with its entanglement and mixing properties with other molecular-weight components, i.e., the high-temperature anti-offset properties and developing performance required for the toner.

If the molecular size Rw (radius of inertia) is less than 1 nm while the absolute molecular weight is in the range of from $1.0\times10^3$ to $1.0\times10^5$, it means that the high polymer has dense random coils and is high in cross-link density. Thus, entanglement with other molecular components and mixing with components other than the resin may be difficult to bring about, and hence the high-temperature anti-offset properties and developing performance required for the toner may lower. Also, such a component is strong in brittleness, resulting in poor pulverizability and inferior toner production stability.

On the other hand, if the molecular size Rw (radius of inertia) is more than 20 nm while the absolute molecular weight is in the range of from $1.0\times10^3$ to $1.0\times10^5$, it means that the molecule is close to straight-chain. Thus, such a component is inferior in elasticity at high temperature, and so, is liable to be a little inferior in high-temperature anti-offset properties, which are to be achieved by the present invention.

The toner of the present invention may preferably contain ODCB-insoluble matter in an amount of from 0.1 to 20% by weight, more preferably from 0.3 to 15% by weight, and still more preferably from 0.5 to 10% by weight, based on the weight of the binder resin. This component is a cross-linked component having strong brittleness, and hence has good thermal stability. Accordingly, the presence of the ODCB-soluble matter in toner particles in a small quantity enables high-quality images to be formed over a long period of time even in a severe environment such as a high-temperature and high-humidity environment. If the ODCB-insoluble matter is in an amount of more than 20% by weight, it may affect the low-temperature fixing performance of the toner, and may be difficult to mix with a low-molecular weight resin, resulting in an inferior pulverizability and tending to result in an increase in liberated resin powder, which is undesirable. If on the other hand it is in an amount of less than 0.1% by weight, a harmful effect may be brought such that image density tends to decrease in a high-temperature and high-humidity environment.

In the toner of the present invention, its tetrahydrofuran (THF)-soluble component may preferably have an acid value of from 0.5 to 50 mg·KOH/g, more preferably from 1.0 to 40 mg·KOH/g, and still more preferably from 2.0 to 35 mg·KOH/g. This is preferable in order to achieve better charge characteristics. If the acid value is not suitable, the toner may have poor chargeability to tend to cause toner scatter and ghost.

The toner of the present invention may preferably have a glass transition temperature (Tg) of from 40° C. to 70° C. If it has a Tg of less than 40° C., the toner tends to have poor anti-blocking properties. If it has the Tg of more than 70° C., the toner tends to have low fixing performance.

In the present invention, the toner contains as the binder resin a "vinyl resin having a carboxyl group" and a "vinyl resin having as partial structure a linkage formed by the reaction of a carboxyl group with an epoxy group". Inasmuch as the toner contains such resins, high chargeability is achievable, and stable images can be obtained over a long period of time without causing a decrease in image density. This is because ester moieties formed in the binder resin by the reaction of epoxy groups with residual carboxyl groups or carboxyl groups having a negative polarity interact with the resin itself or with a negative charge control agent added optionally at toner particle surfaces to improve the dispersion state of the resin or negative charge control agent at the toner particle surfaces. Also, the toner can uniformly stably be charged, and hence excess charge-up can be restrained especially in a low-temperature and low-humidity environment to make sleeve negative ghost not easily occur.

The "vinyl resin having as partial structure a linkage formed by the reaction of a carboxyl group with an epoxy group" used as the binder resin may preferably be one in which the carboxyl group of a vinyl resin having a carboxyl group and the epoxy group of a vinyl resin having an epoxy group are bonded, or one in which the carboxyl group and epoxy group in a vinyl resin having a carboxyl group and an epoxy group are bonded. In particular, the former is more preferred.

The "linkage formed by the reaction of a carboxyl group with an epoxy group" is, when, e.g., a compound having a glycidyl group as the epoxy group is used, the following:

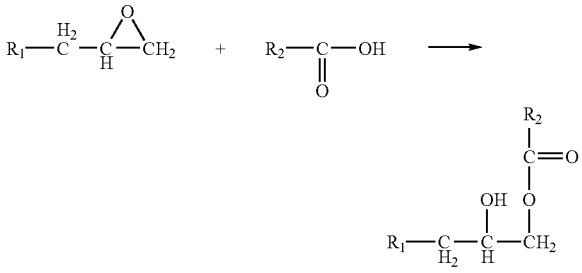

wherein $R_1$ represents a polymer chain of the vinyl resin having an epoxy group, and $R_2$ represents a polymer chain of the vinyl resin having a carboxyl group;

which forms cross-linked structure.

Controlling molecular structure in this way, the distance between cross-linking points is controlled to be longer, and a gel can readily be formed which is not a conventional three-dimensional gel but is made up of an entangled component.

A monomer having a carboxyl group(s) usable for obtaining the "vinyl resin having a carboxyl group" or "vinyl resin having as partial structure a linkage formed by the reaction of a carboxyl group with an epoxy group" according to the present invention may include the following: e.g., unsaturated monocarboxylic acids such as acrylic acid, methacrylic acid, α-ethylacrylic acid, crotonic acid, cinnamic acid, vinylacetic acid, isocrotonic acid, tiglic acid and angelic acid, and α- or β-alkyl derivatives of these; unsaturated dicarboxylic acids such as fumaric acid, maleic acid, citraconic acid, alkenylsuccinic acids, itaconic acid, mesaconic acid, dimethylmaleic acid and dimethylfumaric acid; and monoester derivatives, anhydrides or α- or β-alkyl derivatives of the unsaturated dicarboxylic acids. The above monomers having a carboxyl group(s) may be used alone or in the form of a mixture, or may be copolymerized with other vinyl monomer by a known polymerization method and used.

The "vinyl resin having a carboxyl group" used at the time of obtaining the "vinyl resin having as partial structure a linkage formed by the reaction of a carboxyl group with an epoxy group" according to the present invention may preferably have an acid value of from 1.0 to 60 mg·KOH/g, more preferably from 1.0 to 50 mg·KOH/g, and still more preferably from 2.0 to 40 mg·KOH/g. If the acid value is less than 1.0 mg·KOH/g, the sites at which the carboxyl group and the epoxy group such as a glycidyl group undergo cross-linking reaction are so few that the cross-linking structure may not sufficiently be formed, making it difficult to satisfactorily achieve the improvement of the running (extensive operation) performance of the toner. In such a case, a vinyl resin having a glycidyl group with a high epoxy value may be used to enhance crosslink density to a certain extent. However, residual epoxy groups may affect developing performance or make it difficult to control the cross-linked structure. If the acid value is more than 60 mg·KOH/g, the toner may have so strong moisture absorption as to result in a decrease in image density and an increase in fog.

In the "vinyl resin having a carboxyl group" used for obtaining the "vinyl resin having as partial structure a linkage formed by the reaction of a carboxyl group with an epoxy group" according to the present invention, its THF-soluble matter may preferably have a number-average molecular weight of from 10,000 to 40,000 in order to achieve good fixing performance and developing performance, and have weight-average molecular weight of from 10,000 to 10,000,000 in order to achieve good anti-offset properties, anti-blocking properties and running performance.

The "vinyl resin having a carboxyl group" used for obtaining the "vinyl resin having as partial structure a linkage formed by the reaction of a carboxyl group with an epoxy group" according to the present invention may preferably contain a low-molecular weight component and a high-molecular weight component. The low-molecular weight component may preferably have a peak molecular weight of from 4,000 to 30,000, and more preferably from 5,000 to 25,000, in order to achieve good fixing performance. The high-molecular weight component may preferably have a peak molecular weight of from 100,000 to 1,000,000, and more preferably from 100,000 to 500,000, in order to achieve good anti-offset properties, anti-blocking properties and running performance.

In the "vinyl resin having a carboxyl group" used when obtaining the "vinyl resin having as partial structure a linkage formed by the reaction of a carboxyl group with an epoxy group", the low-molecular weight component and the high-molecular weight component may be used in a weight ratio of low-molecular weight component: high-molecular weight component of from 95:5 to 50:50, and preferably from 90:10 to 55:45. This is preferable in view of fixing performance, and dispersibility of other additives such as wax.

Synthesis methods for producing the high-molecular weight component of the "vinyl resin having a carboxyl group" may include bulk polymerization, solution polymerization, emulsion polymerization and suspension polymerization.

Of these, the emulsion polymerization is a method in which a monomer almost insoluble in water is dispersed with an emulsifying agent in an aqueous phase in the form of small particles to carry out polymerization using a water-soluble polymerization initiator. In this method, a rate of termination reaction is small because the phase where the polymerization is carried out (an oily phase formed of polymers and monomers) is separated from the aqueous phase, so that a product with a high degree of polymerization can be obtained. Moreover, since it enables reaction heat to be easily controlled, the polymerization process is relatively simple and the polymerization product is in the form of fine particles, the colorant, charge control agent and other additives can be mixed with ease when the toner particles are produced, which is advantage to the production of binder resins for toners.

However, the polymer tends to become impure because of the emulsifying agent added, and an operation such as salting-out is required to take out the polymer. In order to avoid such inconvenience, suspension polymerization is advantageous.

In the suspension polymerization, the reaction may preferably be carried out using the polymerizable monomer in an amount of not more than 100 parts by weight, and preferably from 10 to 90 parts by weight, based on 100 parts by weight of an aqueous medium. Usable dispersants include polyvinyl alcohol, partially saponified polyvinyl alcohol, and calcium phosphate, any of which may commonly be used in an amount of from 0.05 to 1 part by weight based on 100 parts by weight of the aqueous medium. Polymerization temperature may be from 50° C. to 95° C. as a suitable range, and may appropriately be selected depending on initiators used and intended polymers.

In obtaining the high-molecular weight component of the "vinyl resin having a carboxyl group", a polyfunctional polymerization initiator as exemplified below may be used as a polymerization initiator in order to achieve the object of the present invention.

As specific examples of the polyfunctional polymerization initiator having polyfunctional structure, the following may be cited: polyfunctional polymerization initiators having in one molecule two or more functional groups such as peroxide groups, having a polymerization initiating function, as exemplified by 1,1-di-t-butylperoxy-3,3,5-trimethylcyclohexane,
1,3-bis(t-butylperoxyisopropyl)benzene,
2,5-dimethyl-2,5-(t-butylperoxy)hexane,
2,5-dimethyl-2,5-di-(t-butylperoxy)hexane,
tris-(t-butylperoxy)triazine,
1,1-di-t-butylperoxycyclohexane,
2,2-di-t-butylperoxybutane,
4,4-di-t-butylperoxyvaleric acid-n-butyl ester,
di-t-butyl peroxyhexahydroterephthalate, di-t-butyl peroxyazelate, di-t-butyl peroxytrimethyladipate,
2,2-bis(4,4-di-t-butylperoxycyclohexyl)propane,
2,2-di-t-butylperoxyoctane, and various polymer oxides; and polyfunctional polymerization initiators having in one molecule both a functional group such as a peroxide group, having a polymerization initiating function, and a polymerizable unsaturated group, as exemplified by diallyl peroxydicarbonate, t-butyl peroxymaleate, t-butyl peroxyallylcarbonate, and t-butyl peroxyisopropylfumarate.

Of these, more preferred ones are 1,1-di-t-butylperoxy-3,3,5-trimethylcyclohexane,
1,1-di-t-butylperoxycyclohexane, di-t-butyl peroxyhexahydroterephthalate, di-t-butyl peroxyazelate,
2,2-bis(4,4-di-t-butylperoxycyclohexyl)propane, and t-butyl peroxyallylcarbonate.

In order to satisfy various properties required for binder resins of toners, these polyfunctional polymerization initiators may preferably be used in combination with a monofunctional polymerization initiator. In particular, in regard to decomposition temperature necessary for attaining a half-life of 10 hours, they may preferably be used in combination with a monofunctional polymerization initiator having a decomposition temperature lower than the decomposition temperature of the polyfunctional polymerization initiator.

Such a monofunctional polymerization initiator may specifically include organic peroxides such as benzoyl peroxide, 1,1-di(t-butylperoxy)-3,3,5-trimethylcyclohexane, n-butyl-4,4-di(t-butylperoxy)valerate, dicumyl peroxide, 2,2-bis(t-butylperoxydiisopropyl)benzene, t-butylperoxycumene, and di-t-butyl peroxide; and azo or diazo compounds such as azobisisobutylonitrile and diazoaminoazobenzene.

These monofunctional polymerization initiators may be added in the monomer at the same time the polyfunctional polymerization initiator is added. In order to keep the proper efficiency of the polyfunctional polymerization initiator, the monofunctional polymerization initiator may preferably be added after the half-life of the polyfunctional polymerization initiator has passed in the polymerization step.

Any of these polymerization initiators may preferably be added in an amount of from 0.01 to 10 parts by weight based on 100 parts by weight of the polymerizable monomer, in view of efficiency.

As methods for synthesizing the low-molecular-weight component of the "vinyl resin having a carboxyl group" used for producing the "vinyl resin having as partial structure a linkage formed by the reaction of a carboxyl group with an epoxy group", known methods may be used. With bulk polymerization, polymers with a low-molecular weight can be obtained by polymerizing the monomer at a high temperature and accelerating the rate of termination reaction, but there is such a problem that the reaction is difficult to control. In this regard, with solution polymerization, the low-molecular weight component can be obtained with ease under mild conditions by utilizing a difference in radical chain transfer due to solvents or adjusting the quantity of an initiator and the reaction temperature, and thus, the solution polymerization is preferred for obtaining the low-molecular weight component in the vinyl resin having a carboxyl group.

As the solvent used in the solution polymerization, xylene, toluene, cumene, cellosolve acetate, isopropyl alcohol or benzene may be cited. Where styrene monomers are used as polymerizable monomers, xylene, toluene or cumene is preferred. The solvent may appropriately be selected depending on monomers to be polymerized or polymers to be obtained. The reaction may normally be carried out at the reaction temperature of 70° C. to 230° C., which may differ depending on solvents and polymerization initiators to be used and polymers to be produced. The solution polymerization may preferably be carried out using the polymerizable monomer in an amount of from 30 to 400 parts by weight based on 100 parts by weight of the solvent. It is also preferable to further mix another polymer in the solution when the polymerization is terminated. Several kinds of polymers may be mixed.

The "vinyl resin having an epoxy group" used for obtaining "vinyl resin having as partial structure a linkage formed by the reaction of a carboxyl group with an epoxy group" is described below. The epoxy group preferred to in the present invention is meant to be a functional group in which an oxygen atom is bonded with different carbon atoms in the same molecule, and has a cyclic ether structure.

As a monomer having an epoxy group that is usable in the present invention, the following may be cited: glycidyl acrylate, glycidyl methacrylate, β-methylglycidyl acrylate, β-methylglycidyl methacrylate, allyl glycidyl ether and allyl β-methylglycidyl ether. A glycidyl monomer represented by the general formula (1) below may preferably be used.

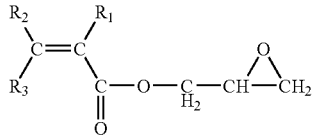

(1)

In the general formula (1), $R_1$, $R_2$ and $R_3$ each represent a hydrogen atom or a functional group selected from the group consisting of an alkyl group, an aryl group, an aralkyl group, a carboxyl group and an alkoxycarbonyl group.

Such a monomer having an epoxy group may be polymerized alone or in a mixture of a plurality of types, or may be copolymerized with other vinyl monomer by known polymerization methods to obtain the vinyl resin having an epoxy group.

In the "vinyl resin having an epoxy group" used when the resin according to the present invention is obtained, its THF-soluble matter may preferably have a weight-average molecular weight (Mw) of from 2,000 to 100,000, more preferably form 2,000 to 50,000, and still more preferably from 3,000 to 40,000. If it has the Mw of less than 2,000, the cross-linked structure in the binder resin tends to come imperfect, and molecules tend to be cut in the kneading step, resulting in low running performance. If it has the Mw of more than 100,000, it tends to lower fixing performance.

The epoxy value is preferably from 0.05 to 5.0 eq/kg, and more preferably from 0.05 to 2.0 eq/kg. If the epoxy value is less than 0.05 eq/kg, it may be difficult for the cross-linking reaction to proceed, and the high-molecular-weight resin may be formed in a small quantity to lower the anti-offset properties and the toughness of the toner. If the epoxy value is more than 5.0 eq/kg, the cross-linking reaction may proceed with ease, but on the other hand a large number of molecules may be cut in the kneading step to halve the effect attributable to anti-offset properties.

The "vinyl resin having an epoxy group" according to the present invention may preferably be used in a mixing proportion in which the epoxy group is in an equivalent weight of from 0.01 to 5.0, and more preferably in an equivalent weight of from 0.03 to 1.0, based on 1 equivalent weight of the total carboxyl groups in the "vinyl resin having a carboxyl group" and a "vinyl resin having a carboxyl group contained in others" which are used when obtaining the "vinyl resin having as partial structure a linkage formed by the reaction of a carboxyl group with an epoxy group". If the epoxy groups are less than 0.01 equivalent weight, the cross-linking points may be so few in the binder resin that the effect attributable to the cross-linking reaction, such as anti-offset properties, may be difficult to bring about. If on the other hand they are more than 5.0 equivalent weight, the cross-linking reaction may take place with ease but on the other hand low dispersibility or low pulverizability may result because of an increase in resin viscosity, tending to lower the development stability.

Where the "vinyl resin having a carboxyl group and an epoxy group" is used when the binder resin according to the present invention is obtained, its THF-soluble matter may preferably have a number-average molecular weight of from 1,000 to 40,000 in order to achieve good fixing performance. The THF-soluble matter may also preferably have a weight-average molecular weight of from 10,000 to 10,000,000 in order to achieve good anti-offset properties and anti-blocking properties.

The "vinyl resin having a carboxyl group and an epoxy group" may be obtained by mixing a monomer having a carboxyl group and a monomer having an epoxy group and copolymerizing the mixture with other vinyl monomer by a known polymerization method.

In the present invention, as methods for obtaining the "vinyl resin having as partial structure a linkage formed by the reaction of a carboxyl group with an epoxy group", the following (1) and (2) may be cited: (1) the vinyl resin having a carboxyl group and the vinyl resin having an epoxy group is mixed in a solution state, followed by heating in a reaction vessel to cause the cross-linking reaction to take place, and (2) the vinyl resin having a carboxyl group and the vinyl resin having an epoxy group are each taken out of a reaction vessel, and dry-blended by means of a mixing machine such as Henschel mixer, followed by heat melt-kneading by means of a twin extruder or the like to cause the reaction of a carboxyl group with an epoxy group to take place to effect cross-linking. The method (1) is more preferred in order to attain the characteristics in the present invention. This is because the molecules of the cross-linked component can be kept from being cut as compared with the case where the melt kneading is carried out, and further the entangled component can be produced with ease.

In particular, after the cross-linking reaction has been completed, it is more preferable that cooling is slowly carried out. Stated specifically, after the reaction has been completed, the temperature may preferably be dropped at a cooling rate of 1° C./min or less, retained at a constant temperature (preferably a temperature of from the melting point to the melting point plus 20° C. of the binder resin) for several hours (preferably 1 to 8 hours) on the way, and thereafter lowered to room temperature. This is because the insoluble matter becomes slowly entangled with one another while the reaction product is retained at a constant temperature, so that entanglement density increases. If the retention time is short, low entanglement density may result, and hence sufficient anti-offset performance may not be brought about. Also, if the reaction product is rapidly cooled at a cooling rate of more than 1° C./min, a three-dimensional gel component tends to be formed to impair low-temperature fixing performance.

It is also preferable that the vinyl resin having a carboxyl group and the vinyl resin having an epoxy group are mixed by adding a solution of the vinyl resin having an epoxy group to a solution in which the vinyl resin having a carboxyl group stands dissolved, over several times while changing the reaction temperature. For example, when the reaction is started, half the solution of the vinyl resin having an epoxy group is added to the solution of the vinyl resin having a carboxyl group, kept at 160° C., and after the reaction is carried out for 2 hours, the remaining solution of the vinyl resin having an epoxy group is added where, after the reaction is carried out for 4 hours, the reaction is terminated. If the reaction is carried out at two steps in this way, it is easy to form the gel with entanglement that is characteristic of the present invention. That is, a gel with mild entanglement is formed at the initial stage, and a gel with strong entanglement is formed at the latter stage. Thus, the gel with two kinds of entanglement, the low-molecular weight component and the ODCB-insoluble matter are mixed in an optimum state, and the respective components can readily come interconnected, so that the low-temperature fixing performance and anti-offset performance which are to be achieved by the present invention can be easily attained. On the other hand, if the reaction is carried out at one time, it is undesirable because the cross-linking reaction may abruptly take place to tend to come up with a three-dimensional harder gel component.

In the present invention, the "vinyl resin having as partial structure a linkage formed by the reaction of a carboxyl group with an epoxy group" may preferably be incorporated with from 0.1 to 60% by weight of THF-insoluble matter. In the case where the THF-insoluble matter is within this range, the resin itself can have appropriate melt viscosity in the kneading step of the production process, and hence a uniform dispersion of materials can be achieved. If the THF-insoluble matter is more than 60% by weight, the resin itself may have so high melt viscosity as to lower the dispersibility of materials.

The vinyl monomer copolymerizable with the monomer having a carboxyl group and the monomer having an epoxy group may include the following: e.g., styrene; styrene derivatives such as o-methylstyrene, m-methylstyrene, p-methylstyrene, p-methoxystyrene, p-phenylstyrene, p-chlorostyrene, 3,4-dichlorostyrene, p-ethylstyrenee, 2,4-dimethylstyrene, p-n-butylstyrene, p-tert-butylstyrene, p-n-hexylstyrene, p-n-octylstyrene, p-n-nonylstyrene, p-n-decylstyrene and p-n-dodecylstyrene; ethylene unsaturated monoolefins such as ethylene, propylene, butylene and isobutylene; unsaturated polyenes such as butadiene and isoprene; vinyl halides such as vinyl chloride, vinylidene chloride, vinyl bromide and vinyl fluoride; vinyl esters such as vinyl acetate, vinyl propionate and vinyl benzoate; α-methylene aliphatic monocarboxyllates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; acrylic esters such as methyl acrylate, ethyl acrylate, n-butyl acrylate, isobutyl acrylate, propyl acrylate, 1-octyl acrylate, dodecyl acrylate, 2-ethylhexyl acrylate, stearyl acrylate, 2-chloroethyl acrylate and phenyl acrylate; vinyl ethers such as methyl vinyl ether, ethyl vinyl ether and isobutyl vinyl ether; vinyl ketones such as methyl vinyl ketone, hexyl vinyl ketone and methyl isopropenyl ketone; N-vinyl compounds such as N-vinylpyrrole, N-vinylcarbazole, N-vinylindole and N-vinylpyrrolidone; vinylnaphthalenes; and acrylic acid or methacrylic acid derivatives such as acrylonitrile, methacrylonitrile and acrylamide. Any of these vinyl monomers may be used alone or in the form of a mixture of two or more monomers.

It is preferred to form a copolymer which makes use of styrene monomers that give a styrene copolymer and a styrene-acrylic or methacrylic copolymer, and the binder resin according to the present invention may preferably be a styrene resin composed chiefly of units derived from styrene. Further, in view of fixing performance and mixing properties, a styrene resin component or a styrene-acrylic or methacrylic copolymer component is contained preferably in an amount of at least 65% by weight.

The binder resin according to the present invention contains the vinyl resin having a carboxyl group. Inasmuch as the vinyl resin having a carboxyl group is contained, the binder resin according to the present invention has an acid value. Since the resin having a carboxyl group is a vinyl resin, a good compatibility with the "vinyl resin having as partial structure a linkage formed by the reaction of a carboxyl group with an epoxy group" can be achieved. As the "vinyl resin having a carboxyl group" incorporated in the binder resin, the same resin as the vinyl resin may be used which is used when the "vinyl resin having as partial structure a linkage formed by the reaction of a carboxyl group with an epoxy group" is produced.

The binder resin according to the present invention may also be incorporated with i) the vinyl resin having an epoxy group, ii) a resin mixture of the vinyl resin having a carboxyl group and the vinyl resin having an epoxy group or iii) the vinyl resin having a carboxyl group and an epoxy group. As these vinyl resins, the same vinyl resins as used for producing the "vinyl resin having as partial structure a linkage formed by the reaction of a carboxyl group with an epoxy group" may be used.

The binder resin according to the present invention may also preferably have an acid value of from 1 to 50 mg·KOH/g, more preferably from 1 to 40 mg·KOH/g, and still more preferably from 2 to 40 mg·KOH/g. The use of the binder resin having such an acid value enables the chargeability of the toner to be suitably controlled especially in a high-temperature and high-humidity environment.

Besides, the binder resin according to the present invention may contain such polymers as shown below. For example, the following may be cited: homopolymers of styrene or styrene derivatives, such as polystyrene, poly-p-chlorostyrene, and polyvinyl toluene; styrene copolymers such as a styrene-p-chlorostyrene copolymer, a styrene-vinyltoluene copolymer, a styrene-vinylnaphthalene copolymer, a styrene-acrylate copolymer, a styrene-methacrylate copolymer, a styrene-methyl α-chloromethacrylate copolymer, a styrene-acrylonitrile copolymer, a styrene-methyl vinyl ether copolymer, a styrene-ethyl vinyl ether copolymer, a styrene-methyl vinyl ketone copolymer, a styrene-butadiene copolymer, a styrene-isoprene copolymer, and a styrene-acrylonitrile-indene copolymer; polyvinyl chloride, phenolic resins, natural-resin modified phenol resins, natural-resin modified maleic acid resins, acrylic resins, methacrylic resins, polyvinyl acetate, silicone resins, polyester resins, polyurethane resins, polyamide resins, furan resins, epoxy resins, xylene resins, polyvinyl butyral, terpene resins, coumarone-indene resins, and petroleum resins. In the present invention, any of these optional-component resins may be contained in the binder resin in an amount of 30% by weight or less, and preferably 20% by weight or less.

In the toner of the present invention, toner particles may preferably be incorporated with a hydrocarbon wax (a) having, in regard to an endothermic peak at the time of heating in a DSC curve obtained by measurement with a differential scanning calorimeter, an endothermic-peak leading temperature of 80° C. or more, an endothermic onset temperature of 105° C. or less and an endothermic main peak temperature in the range of from 100° C. to 120° C., and also having a viscosity at 120° C. of 100 mPa·s or less. By combining such a wax and the low viscosity resin in the present invention, compatibility with each other is increased to improve wax dispersibility and achieve stable charging, rendering image density stable during running.

In the case where such a wax having an endothermic-peak leading temperature of 80° C. or more is incorporated in toner particles, the wax may only a little affect the anti-blocking properties of the toner, and hence a toner having good anti-blocking properties can be obtained. If a wax having a leading temperature of less than 80° C. is used, the toner may begin to undergo plastic deformation at a relatively low temperature over a long period of time to tend to be inferior in storage stability or to cause deterioration in developing performance for a rise in temperature. Further, it is a characteristic feature that the endothermic onset temperature is 105° C. or less (preferably in the range of from 90° C. to 102° C.). Due to this feature, the wax can be desirably mixed with the low viscosity resin, and may no longer adversely affect the toner at the time of fixing. If the endothermic onset temperature is more than 105° C., the temperature at which the toner undergo plastic deformation in a short period of time is raised, and molecular motion of the low-molecular component is inhibited at the time of fixing, impairing fixing performance.

It is also a characteristic feature that the endothermic main peak temperature is in the range of from 100° C. to 120° C. (preferably from 102° C. to 115° C.) Due to this feature, good high-temperature anti-offset properties can be achieved. If the endothermic main peak temperature is less than 100° C., the wax component may dissolve in the binder resin before reaching a high temperature, and it is difficult to achieve sufficient anti-offset performance at the time of high temperature. If the endothermic main peak temperature is more than 120° C., the wax may be poorly mixed with the resin component to be present as liberated wax, there is a possibility of adversely affecting charging stability.

In the DSC measurement in the present invention, the exchange of heat is measured to make observations of the behavior, and hence the measurement must be made with a differential scanning calorimeter of a highly precise, inner-heat input compensation type. For example, usable are, e.g., DSC-7, manufactured by Perkin-Elmer Corporation; DSC-TA, manufactured by Seiko Instruments, Inc.; and DSC Q-1000 (manufactured by TA Instruments Japan Ltd.).

It is measured by a method according to ASTM D3418-82. In the present invention, a DSC curve is used which is obtained by measurement when the temperature is raised once to erase previous history and thereafter dropped and raised at a temperature rate of 10° C./min within the temperature range of from 0° C. to 200° C. (see FIG. 1). Each temperature is defined in the following way.

Leading temperature (LP) to the peak: the temperature at which the peak curve is seen to have clearly come away from the base line. More specifically, it refers to the temperature at which the differential value of the peak curve is positive and an increase in the differential value begins to become large or the temperature at which the differential value converts from negative to positive.

Endothermic onset temperature (OP): the temperature at the intersection point of the base line and a tangent line of the peak curve drawn at a point where the differential value of the peak curve is maximum. In the toner containing a wax, the endothermic peak having a peak at a temperature of 70° C. or more is targeted.

Endothermic peak temperature (PP): the temperature at a main peak top.

The hydrocarbon wax (a) may preferably have a viscosity at 120° C. of 100 mPa·s or less, and more preferably 80 mPa·s or less. If it has a viscosity of more than 100 mPa·s, it may be inferior in plasticity and release properties to affect good fixing performance and anti-offset properties. Also, because of a difference in viscosity, it may poorly mixed with the resin in the present invention, so that liberated wax may occur to tend to cause faulty development.

In the present invention, the viscosity of the hydrocarbon wax is determined according to JIS K 6862-7.2.

As the hydrocarbon wax (a) used in the present invention, usable are low-molecular weight alkylene polymers obtained by radical polymerization of alkylens under high pressure or under low pressure the presence of a Ziegler catalyst; alkylene polymers obtained by thermal decomposition of high-molecular weight alkylene polymers; and hydrocarbon waxes obtained by extracting and fractionating specific components from synthetic hydrocarbon waxes obtained by hydrogenation of distillation residues of hydrocarbons obtained by the Arge process from synthetic gases containing carbon monoxide and hydrogen. The hydrocarbon waxes are fractionated by a fractionation crystallization system that utilizes press sweating, solvent fractionation or vacuum distillation. That is, usable are those obtained by removing low-molecular weight matter or extracting low-molecular weight matter by using any of these methods, and those from which low-molecular weight matter has further been removed.

Hydrocarbons serving as a matrix may include those synthesized by reacting carbon monoxide with hydrogen in the presence of a metal oxide type catalyst (in general, a catalyst of a two or more multiple system), as exemplified by hydrocarbons having several hundred carbon atoms, obtained by the Synthol process, the Hydrocol process (making use of a fluidized catalyst bed) or the Arge process (making use of a fixed catalyst bed) which can produce waxy hydrocarbons in large quantity; and hydrocarbons obtained by polymerization of alkylenes such as ethylene in the presence of a Ziegler catalyst; all of which are preferable as having less and small branches and being saturated long straight chain hydrocarbons. In particular, hydrocarbon waxes synthesized by a method not relying on the polymerization of alkylenes are preferred in view of their structure and their molecular weight distribution which allows easy fractionation.

Referring to the molecular weight distribution of the wax, it is desired that the number-average molecular weight (Mn) is from 550 to 1,200, and preferably from 600 to 1,000, the weight-average molecular weight (Mw) is from 800 to 3,600, and preferably from 900 to 3,000, and the value of Mw/Mn is 3 or less, preferably 2.5 or less, and particularly preferably 2.0 or less. Also, a peak is present in the molecular weight region of from 700 to 2,400, preferably from 750 to 2,000, and particularly preferably from 800 to 1,600. If the wax has such molecular weight distribution, it enable the toner to have preferable thermal properties. That is, if the wax has molecular weights smaller than the above ranges, the toner may excessively undergo thermal effect to come inferior in anti-blocking properties and developing performance. If the wax has molecular weights larger than the above ranges, the toner can not effectively utilize the heat coming from the outside, and can not achieve good fixing performance and anti-offset properties.

It is desirable that the hydrocarbon wax (a) has a hydroxyl value (Hv) of less than 5 mg·KOH/g and an ester value (Ev) of less than 1 mg·KOH/g, and preferably a hydroxyl value (Hv) of less than 1 mg·KOH/g, an ester value (Ev) of less than 1 mg·KOH/g and an acid value (Av) of less than 1 mg·KOH/g.

In addition to the hydrocarbon wax (a), the toner may preferably contain a hydrocarbon wax (b) which has a hydroxyl value (Hv) of from 5 to 150 mg·KOH/g, an ester value (Ev) of from 1 to 50 mg·KOH/g and a viscosity at 120° C. of 80 mPa·s or less, wherein an acid value ($Av_B$) of the binder resin and the hydroxyl value (Hv) of the hydroxyl value (Hv) of the hydrocarbon wax (b) satisfy the following expression:

$$0.05 \leqq Av_B/Hv \leqq 3.5.$$

The hydrocarbon wax (b) used in the present invention is a wax which may preferably contain hydrocarbon molecular chains having such structures as shown below. It is a wax having in the hydrocarbon wax molecule at least i) a molecular chain having the structure of a secondary alcohol which has a hydroxyl group on the secondary carbon atom and is represented by the following partial structural formula (A), and ii) a molecular chain having the structure of an ester which has an ester linkage and is represented by the following partial structural formula (B). It may include both the structures in one molecular chain.

A wax is also preferable which further has in the hydrocarbon wax molecule iii) molecular chains having the structures of acid radicals which have a carboxyl group on the primary or secondary carbon atom and are represented by the following partial structural formulas (C) and (D). The wax may also have a molecular chain having the structure of a primary alcohol which has a hydroxyl group on the primary carbon atom and is represented by the following partial structural formula (E). It may have in one molecular chain any of the structures represented by the following partial structural formulas (A), (B), (C), (D) and (E).

(A)

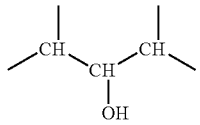

(B)

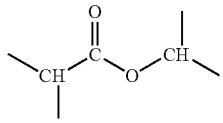

(C)

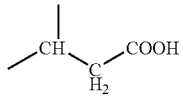

(D)

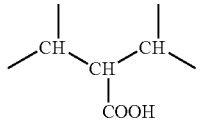

(E)

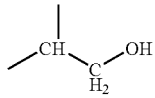

Since the hydrocarbon wax (b) used in the present invention suitably has hydroxyl groups in the molecule, the hydrocarbon wax (b) can be dispersed in the binder resin in the form of fine particles. Hence, an appropriate plasticizing effect can be obtained, and the toner is improved in fixing performance. If the hydrocarbon wax (b) has a hydroxyl value of less than 5 mg·KOH, the hydrocarbon wax (b) can not sufficiently finely be dispersed in the binder resin, so that the toner may have low fixing performance. If on the other hand the component has a hydroxyl value of more than 150 mg·KOH, the hydrocarbon wax (b) is so large in plasticizing effect that the toner may have low anti-blocking properties.

In addition, it is desirable that the hydrocarbon wax (b) used in the present invention has an acid value (Av) of 1 to 30 mg·KOH/g, preferably 1 to 15 mg·KOH/g, more preferably 1 to 10 mg·KOH/g. Such an acid value of the hydrocarbon wax increases the interfacial adhesion of the wax to other components included in the toner, allows the wax to enhance the effect of plasticizing the toner, and improves the fixing performance of the toner. If the acid value of the wax is less than 1 mg·KOH/g, the interfacial adhesion of the wax to other components included in the toner is so small that the wax is apt to be liberated and the action of the wax cannot be sufficiently obtained in some cases. On the other hand, if the acid value of the wax is more than 30 mg·KOH/g, the interfacial adhesion is so large that the toner is excessively plasticized so as not to retain sufficient releasability.

In addition, where an ester structure is present in the hydrocarbon wax (b) as in the above formula (B), the affinity with the binder resin component of the toner is so high that the hydrocarbon wax (b) can be present in toner particles in a closely uniform state, so that the action of the hydrocarbon wax (b) can be effectively exhibited. As the ester value the hydrocarbon wax (b) may have, it may preferably be from 1 to 50 mg·KOH. If the hydrocarbon wax (b) has an ester value of less than 1 mg·KOH, the effect of the hydrocarbon wax (b) on the fixing performance of the toner is reduced. If on the other hand the hydrocarbon wax (b) has an ester value of more than 50 mg·KOH, the hydrocarbon wax (b) has so high an affinity with the binder resin that the deterioration of the binder resin tends to be accelerated, so that the toner may be inferior in developing performance when used for a long term.

In regard to an endothermic peak at the time of heating in a DSC curve prepared by measurement with a differential scanning calorimeter, the hydrocarbon wax (b) in the present invention may have an endothermic peak temperature of from 65° C. to 140° C., preferably from 70° C. to 130° C., and more preferably from 70° C. or more to less than 100° C. This is preferable in view of the achievement of good fixing performance, anti-offset properties and anti-blocking properties of the toner.

The hydrocarbon wax (b) may preferably have a viscosity at 120° C. of 80 mPa·s or less, more preferably 50 mPa·s or less, and still more preferably 30 mPa·s or less. Where the viscosity at 120° C. is not more than the stated value, the toner can be made to have low melt viscosity, which is preferable in that good fixing performance can be achieved. If the wax has a viscosity at 120° C. of more than 80 mPa·s, the toner may have insufficient fixing performance, and besides, the hydrocarbon wax (b) may be poorly mixed with the resin and hydrocarbon wax (a) according to the toner of the present invention, and hence is difficult to disperse in toner particles, so that image density may decrease due to faulty charging.

Both of the above hydrocarbon waxes (a) and (b) may be preferably used in combination in order to improve the performance of the toner. The reasons therefor are as follows: in the present invention, the hydrocarbon wax (b) is appropriately finely dispersed in the toner particles, and the hydrocarbon wax (b) has so high an affinity with the hydrocarbon wax (a) that, in regard to the hydrocarbon wax (a) as well, finer dispersion can be achieved as compared with a case in which the hydrocarbon wax (a) is used alone, so that the hydrocarbon wax (a) can quickly exude on the toner particle surfaces at the time of fixing, and can provide the toner with good anti-offset properties.

The hydrocarbon wax (b) also has a good affinity with the binder resin and is high in plasticity, and hence, may accelerate the deterioration of the toner, and the toner is accelerated to deteriorate due to the stress applied to the toner in a developing assembly during long-term use especially in a high-temperature and high-humidity environment. However, in the present invention, the excessive plasticizing action of the hydrocarbon wax (b) can be restrained in virtue of the release action the hydrocarbon wax (a) has on the binder resin, and the good developing performance of the toner can be maintained over a long period of time.

In addition, when viscosity ($\eta a$) of the hydrocarbon wax (a) at 120° C. and viscosity ($\eta b$) of the hydrocarbon wax (b) at 120° C. satisfy the following relationship:

$$\eta a > \eta b,$$

the hydrocarbon wax (a) and hydrocarbon wax (b) can be restrained from agglomerating, and can be finely dispersed in toner particles.

The hydrocarbon wax (a) and hydrocarbon wax (b) in the present invention may also have a penetration at 25° C. of 15 or less, preferably 12 or less, and more preferably 10 or less. This is preferable in order for the toner to be improved in chargeability and to achieve higher developing performance in a high-temperature and high-humidity environment as well. If the hydrocarbon waxes have a penetration at 25° C. of more than 15, the toner may have low anti-blocking properties. In the present invention, the penetration of the hydrocarbon waxes are determined according to JIS K 2235-5.4.

The hydrocarbon wax (a) and hydrocarbon wax (b) in the present invention may be contained in such a proportion that the content of the hydrocarbon wax (b) is from 0.05 to 20, preferably from 0.07 to 15, and more preferably from 0.1 to 10, regarding the content of the hydrocarbon wax (a) as 1. If the proportion of content of the hydrocarbon wax (b) to the hydrocarbon wax (a) is outside the above range, the toner may have insufficient fixing performance and anti-offset properties.

The waxes used in the present invention may be added at the time of the polymerization for producing the resin, at the time of cross-linking the resin and at the time of melt-kneading toner materials, any cases of which will do. It is preferable for them to be added at the time of melt-kneading toner materials.

Besides the waxes described above, the wax used in the present invention may include the following: for example, paraffin wax and derivatives thereof, montan wax and derivatives thereof, microcrystalline wax and derivatives thereof, Fischer-Tropsch wax and derivatives thereof, polyolefin wax and derivatives thereof, and carnauba wax and derivatives thereof. The derivatives may include oxides, block copolymers with vinyl monomers, and graft modified products.

As specific examples, the wax may include BISKOL (registered trademark) 330-P, 550-P, 660-P, TS-200 (available from Sanyo Chemical Industries, Ltd.); HIWAX 400P, 200P, 100P, 410P, 420P, 320P, 220P, 210P, 110P (available from Mitsui Chemicals, Inc.); SASOL H1, H2, C80, C105, C77 (available from Schumann Sasol Co.); HNP-1, HNP-3, HNP-9, HNP-10, HNP-11, HNP-12 (available from Nippon Seiro Co., Ltd.); UNILIN (registered trademark) 350, 425, 550, 700, UNICID (registered trademark) 350, 425, 550, 700 (available from Toyo-Petrolite Co., Ltd.); and Japan wax, bees wax, rice wax, candelilla wax, carnauba wax (available from CERARICA NODA Co., Ltd.).

In the present invention, it is effective that any of these waxes is used in a total content of from 0.1 to 15 parts by weight, and preferably from 0.5 to 12 parts by weight, based on 100 parts by weight of the binder resin.

The toner of the present invention may preferably be incorporated with a charge control agent. As charge control agents capable of controlling the toner to be negatively chargeable, for example, organic metal complex salts and chelate compounds are effective, including monoazo metal complexes, acetylyacetone metal complexes, aromatic hydroxycarboxylic acid and aromatic dicarboxylic acid type metal complexes. Besides, they may also include aromatic hydroxycarboxylic acids, aromatic mono- and polycarboxylic acids, and metal salts, anhydrides or esters thereof, and phenol derivatives such as bisphenol. Also, as charge control agents capable of controlling the toner to be negatively chargeable, azo type metal complexes represented by the following general formula (2) are preferred.

(2)

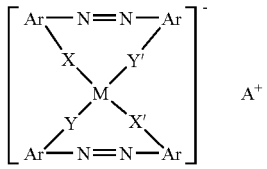

In the formula, M represents a coordinated central metal selected from the group consisting of Sc, Ti, V, Cr, Co, Ni, Mn and Fe, Ar represents a phenyl group or a naphthyl group which may have a substituent selected from the group consisting of a nitro group, a halogen atom, a carboxyl group, an anilide group and an alkyl group having 1 to 18 carbon atoms and an alkoxyl group having 1 to 18 carbon atoms, X, X', Y and Y' each represent one or two linking group(s) selected from the group consisting of —O—, —CO—, —NH— or —NR— (R is an alkyl group having 1 to 4 carbon atoms), and $A^+$ represents a hydrogen ion, a sodium ion, a potassium ion, an ammonium ion or an aliphatic ammonium ion, or a mixture of any of these.

With the charge control agents represented by the above general formula (2), as the central metal, Fe or Cr is particularly preferred. As the substituent, a halogen atom, an alkyl group or an anilide group is preferred. As the counter ion, a hydrogen ion, an alkali metal ammonium ion or an aliphatic ammonium ion is preferred. A mixture of complexes having different counter ions may also preferably be used.

The charge control agents capable of controlling the toner to be negatively chargeable may also include, e.g., basic organic acid metal complexes represented by the following general formula (3).

(3)

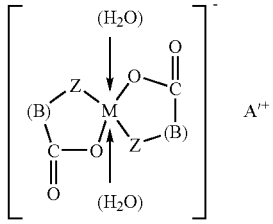

In the formula, M represents a coordinated central metal, including Cr, Co, Ni, Mn, Fe, Zn, Al and B. B represents;

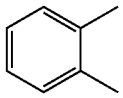

(which may have a substituent such as an alkyl group)

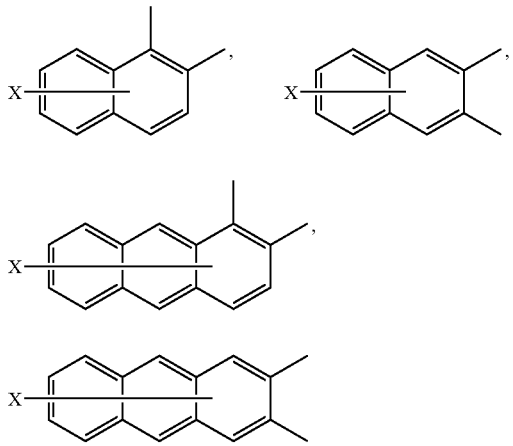

(X represents a hydrogen atom, a halogen atom, a nitro group or an alkyl group), and

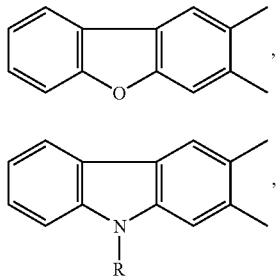

-continued

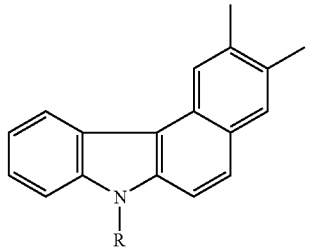

(R represents a hydrogen atom, an alkyl group having 1 to 18 carbon atoms or an alkenyl group having 2 to 18 carbon atoms);

$A'^{+}$ represents a hydrogen ion, a sodium ion, a potassium ion, an ammonium ion, an aliphatic ammonium ion, or nothing, Z represents —O— or

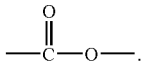

In the charge control agents represented by the above general formula (3), as the central metal, Fe, Cr, Si, Zn or Al is particularly preferred. As the substituent, an alkyl group, an anilide group, an aryl group or a halogen atom is preferred. As the counter ion, a hydrogen ion, an ammonium ion or an aliphatic ammonium ion is preferred.

Of the charge control agents represented by the above general formula (3), the azo type metal complexes are preferred. Further, azo type metal complexes represented by the following general formula (4) are most preferred.

(4)

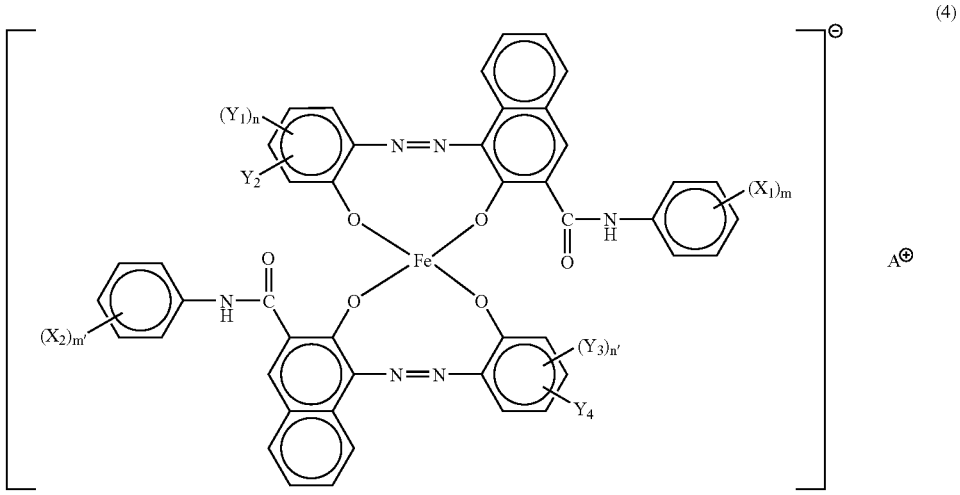

wherein $X_1$ and $X_2$ each represent a hydrogen atom, a lower alkyl group, a lower alkoxyl group, a nitro group or a halogen atom, and m and m' each represent an integer of 1 to 3; $Y_{1\ and\ Y3}$ each represent a hydrogen atom, an alkyl group having 1 to 18 carbon atoms, an alkenyl group having 2 to 18 carbon atoms, a sulfonamide group, a mesyl group, a sulfonic acid group, a carboxyester group, a hydroxyl group, an alkoxyl group having 1 to 18 carbon atoms, an acetylamino group, a benzoyl group, an amino group or a halogen atom; n and n' each represent an integer of 1 to 3; and $Y_2$ and $Y_4$ each represent a hydrogen atom or a nitro group; (the above $X_1$ and $X_2$, m and m', $Y_{1\ and\ Y3}$, n and n', and $Y_2$ and $Y_4$ may be the same or different); and $A^+$ represents an ammonium ion, an alkali metal ion, a hydrogen ion or mixed ions of any of these.

Specific examples of the azo type iron compound are shown below as the following structural formulas (5) to (10).

(5)

(5)

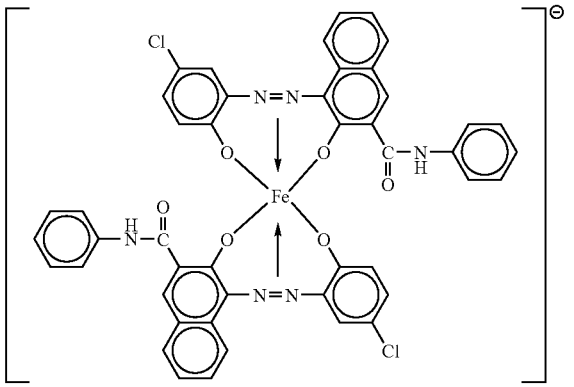

Counter ion: $NH_4^+$ (or $H^+$, $Na^+$, $K^+$ or mixed ions of any of these)

(6)

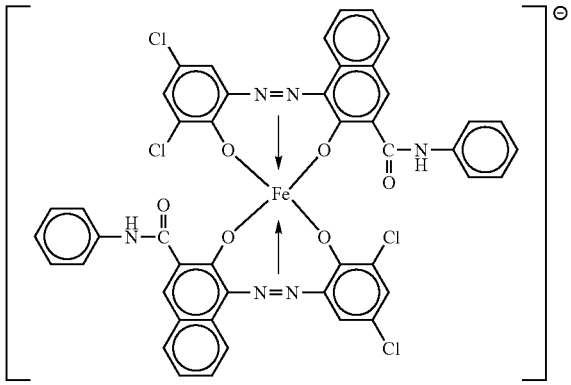

Counter ion: $NH_4^+$ (or $H^+$, $Na^+$, $K^+$ or mixed ions of any of these)

(7)

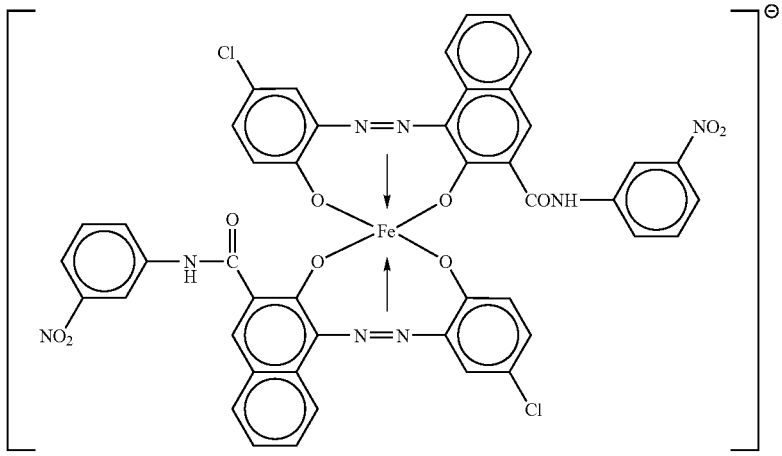

Counter ion: $NH_4^+$ (or $H^+$, $Na^+$, $K^+$ or mixed ions of any of these)

(8)

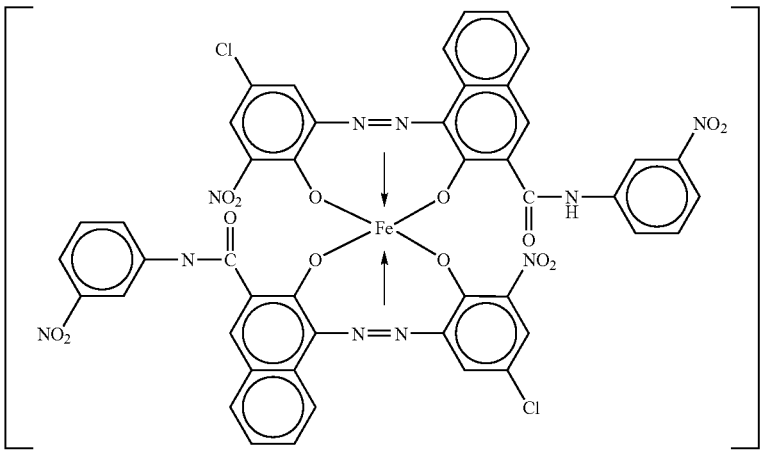

Counter ion: $NH_4^+$ (or $H^+$, $Na^+$, $K^+$ or mixed ions of any of these)

(9)

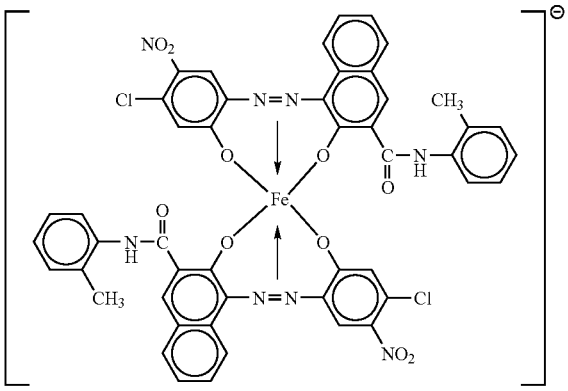

Counter ion: $NH_4^+$ (or $H^+$, $Na^+$, $K^+$ or mixed ions of any of these)

(10)

(10)

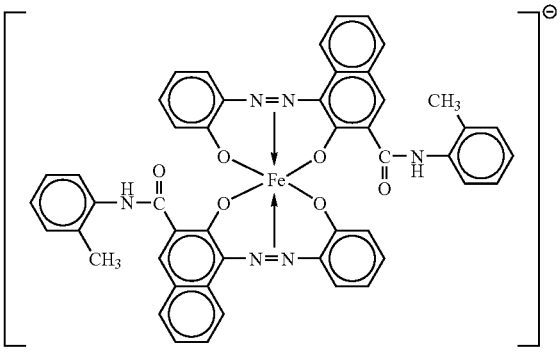

Counter ion: $NH_4^+$ (or $H^+$, $Na^+$, $K^+$ or mixed ions of any of these)

A charge control agent capable of controlling the toner to be positively chargeable may include, e.g., Nigrosine, and its products modified with a fatty acid metal salt; quaternary ammonium salts such as tributylbenzylammonium 1-hydroxy-4-naphthosulfonate and tetrabutylammonium teterafluoroborate, and analogues of these, i.e., onium salts such as phosphonium salts, and lake pigments of these, triphenylmethane dyes and lake pigments of these (lake-forming agents include tungstophosphoric acid, molybdophosphoric acid, tungstomolybdophosphoric acid, tannic acid, lauric acid, gallic acid, ferricyanides and ferrocyanides); metal salts of higher fatty acids; diorganotin oxides such as dibutyltin oxide, dioctyltin oxide and dicyclohexyltin oxide; diorganotin borates such as dibutyltin borate, dioctyltin borate and dicyclohexyltin borate; and guanidine compounds and imidazole compounds. Any of these may be used alone or in a combination of two or more kinds. Of these, triphenylmethane compounds, and quaternary ammonium salts whose counter ions are not halogens may preferably be used.

Homopolymers of monomers represented by the following general formula (11); or copolymers of polymerizable monomers such as styrene, acrylates or methacrylates as described above may also be used as positive charge control agents. In this case, these charge control agents have even the action of binder resins (as a whole or in part).

(11)

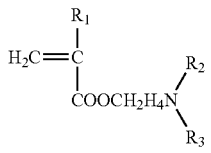

wherein $R_1$ represents a hydrogen atom or a methyl group; $R_2$ and $R_3$ each represent a substituted or unsubstituted alkyl group (preferably having 1 to 4 carbon atoms).

As the positively chargeable charge control agents, compounds represented by the following general formula (12) are particularly preferred.

(12)

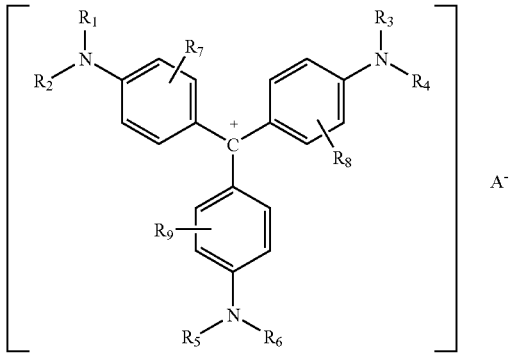

wherein $R_1$, $R_2$, $R_3$, $R_4$, $R_5$ and $R_6$ may be the same or different from one another and each represent one or two or more selected from a hydrogen atom, a substituted or unsubstituted alkyl group and a substituted or unsubstituted aryl group; $R_7$, $R_8$ and $R_9$ may be the same or different from one another and each represent one or two or more selected from a hydrogen atom, a halogen atom, an alkyl group and an alkoxyl group; and $A^-$ represents a negative ion selected from a sulfate ion, a borate ion, a phosphate ion, a carboxylate ion, an organoborate ion and a tetrafluorborate ion.

In specific trade names, agents for negative charging may be exemplified by Spilon Black TRH, T-77, T-95 (available from Hodogaya Chemical Co., Ltd.); BONTRON (registered trademark) S-34, S-44, S-54, E-84, E-88, E-89 (available from Orient Chemical Industries Ltd.). Preferable agents for positive charging may include, e.g., TP-302, TP-415 (available from Hodogaya Chemical Co., Ltd.); BONTRON (registered trademark) N-01, N-04, N-07, P-51 (available from Orient Chemical Industries Ltd.), and Copy Blue PR (Klariant GmbH).

As methods for having the charge control agent included in the toner, available are a method of adding it internally to toner particles and a method of adding it externally to toner particles. The amount of the charge control agent to be used depends on types of the binder resin, the presence or absence of other additives, and manners in which the toner is produced, including a manner of dispersion, and can not absolutely be specified. Preferably, the charge control agent may be used in an amount of from 0.1 to 10 parts by weight, and more preferably from 0.1 to 5 parts by weight, based on 100 parts by weight of the binder resin.

The toner of the present invention may contain a magnetic material as well. The magnetic material may serve also as a colorant. The magnetic material used in the toner may include iron oxides such as magnetite, hematite and ferrite; metals such as iron, cobalt and nickel, or alloys of any of these metals with a metal such as aluminum, cobalt, copper, lead, magnesium, tin, zinc, antimony, beryllium, bismuth, cadmium, calcium, manganese, selenium, titanium, tungsten or vanadium, and mixtures of any of these.

These magnetic materials preferably have a number-average particle diameter of from 0.05 μm to 1.0 μm, and more preferably from 0.1 μm to 0.5 μm. As the magnetic material, preferably usable are those having a BET specific surface area of from 2 to 40 $m^2/g$, and more preferably from 4 to 20 $m^2/g$. There are no particular limitations on their particle shapes, and any desired shapes may be used. As magnetic properties, the magnetic material may have a saturation magnetization of from 10 to 200 $Am^2/kg$ (more preferably from 70 to 100 $Am^2/kg$), a residual magnetization of from 1 to 100 $Am^2/kg$ (more preferably from 2 to 20 $Am^2/kg$) and coercive force of from 1 to 30 kA/m (more preferably from 2 to 15 kA/m) under the application of a magnetic field of 795.8 kA/m, which may preferably be used. Any of these magnetic materials may be used in an amount of from 20 to 200 parts by weight, and preferably from 40 to 150 parts by weight, based on 100 parts by weight of the binder resin.

The number-average particle diameter can be determined by using a digitizer on the basis of a photograph taken on a transmission electron microscope or the like. The magnetic properties of the magnetic material may be measured with "Vibration Sample Type Magnetism Meter VSM 3S-15" (manufactured by Toei Industry Co., Ltd.) under the application of an external magnetic field of 795.8 kA/m. To measure the specific surface area, according to a BET method and using a specific surface area measuring instrument AUTOSOBE 1 (manufactured by Yuasa Ionics Co.), nitrogen gas is adsorbed on the surface of a sample, and the BET specific surface area is calculated using a BET multipoint method.

As other colorants usable in the toner of the present invention, they may include any suitable pigments and dyes. The pigments may include carbon black, Aniline Black, acetylene black, Naphthol Yellow, Hanza Yellow, Rhodamine Lake, Alizarine Lake, red iron oxide, Phthalocyanine Blue and Indanethrene Blue. Any of these may be used in an amount necessary for maintaining the optical density of fixed images, and may be added in an amount of from 0.1 to 20 parts by weight, and preferably from 0.2 to 10 parts by weight, based on 100 parts by weight of the binder resin. The dyes may include azo dyes, anthraquinone dyes, xanthene dyes and methine dyes. The dye may be added in an amount of from 0.1 to 20 parts by weight, and preferably from 0.3 to 10 parts by weight, based on 100 parts by weight of the binder resin.

It is preferred that inorganic fine particles or hydrophobic inorganic fine particles are externally added to the toner particles (toner base particles) in the present invention. For example, they may include fine silica powder and fine titanium oxide powder, or their hydrophobic-treated products. These may preferably be used alone or in combination.

The fine silica powder may include silica called dry-process silica or fumed silica produced by vapor phase oxidation of silicon halides and wet-process silica produced from water glass or the like. The dry-process silica is preferred, as having less silanol groups on the surfaces and inside of the fine silica particles and leaving less production residues.

Further, the fine silica powder is preferably one subjected to hydrophobic treatment. The hydrophobic treatment may be performed by chemical treatment with an organosilicon compound capable of reacting with or being physically adsorbed on the fine silica powder. As one of preferable methods, a method may be cited in which the dry-process fine silica powder produced by vapor phase oxidation of a silicon halide is treated with an organosilicon compound such as silicone oil after it has been treated with a silane compound or at the same time it is treated with a silane compound.

The silane compound used in the hydrophobic treatment may include hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilane mercaptan, trimethylsilyl mercaptan, triorganosilyl acrylate, vinyldimethylacetoxysilane, dimethylethoxysilane, dimethyldimethoxysilane, diphenyldiethoxysilane, hexamethyldisiloxane, 1,3-divinyltetramethyldisiloxane, and 1,3-diphenyltetramethyldisiloxane.

The organosilicon compound may include silicone oils. As preferred silicone oils, those having a viscosity at 25° C. of from 30 to 1,000 $mm^2/s$ may be used. For example, preferred are dimethylsilicone oil, methylphenylsilicone oil, α-methylstyrene modified silicone oil, chlorophenylsilicone oil and fluorine modified silicone oil.

For the treatment with silicone oil, a method may be employed in which the fine silica powder treated with a silane compound and the silicone oil are directly mixed by means of a mixing machine such as Henschel mixer, or the silicone oil is sprayed on the fine silica powder as base material. Besides, the silicone oil may be dissolved or dispersed in a suitable solvent and thereafter the base fine silica powder may be mixed, followed by removing the solvent to prepare the treated product.

As preferable hydrophobic treatment of the fine silica powder, a method is available in which the fine silica powder is first treated with hexamethyldisilazane and then treated with silicone oil to prepare the treated product.

It is preferable to treat the fine silica powder with a silane compound and thereafter to carry out treatment with silicone oil as described above, because the hydrophobicity can effectively be improved.

The above hydrophobic treatment and further the treatment with silicone oil for the silica fine powder may also be applied to fine titanium oxide powder. Such a powder is also preferable as in the silica fine powder.

To the toner particles (toner base particles) in the present invention, if necessary, additives other than the fine silica powder or fine titanium oxide powder may be externally added.

For example, they are fine resin particles or inorganic fine particles that function as a charge auxiliary agent, a conductivity-providing agent, a fluidity-providing agent, an anti-caking agent, a release agent at the time of heat roll fixing, a lubricant and an abrasive.

As the fine resin particles, those having an average particle diameter of from 0.03 μm to 1.0 μm are preferred. A polymerizable monomer making up that resin may include such monomers as exemplified by styrene; styrene derivatives such as o-methylstyrene, m-methylstyrene, p-methylstyrene, p-methoxystyrene and p-ethylstyrene; acrylic acid; methacrylic acid; acrylic esters such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate and phenyl acrylate; methacrylic esters such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; and monomers such as acrylonitrile, methacrylonitrile and acrylamides.

As a polymerization process, it may include suspension polymerization, emulsion polymerization and soap-free polymerization. More preferably, resin particles obtained by soap-free polymerization are favorable.

Other fine particles may include lubricants such as polyfluoroethylene powder, zinc stearate powder and polyvinylidene fluoride powder (in particular, polyvinylidene fluoride powder is preferred); abrasives such as cerium oxide powder, silicon carbide powder and strontium titanate powder (in particular, strontium titanate powder is preferred); fluidity-providing agents such as titanium oxide powder and aluminum oxide powder (in particular, hydrophobic one is preferred); anti-caking agents; and conductivity-providing agents such as carbon black, zinc oxide powder, antimony oxide powder and tin oxide powder. White fine particles and black fine particles having a polarity opposite to that of the toner may also be used as a developing performance improver in a small quantity.

The fine resin particles, inorganic fine particles or hydrophobic inorganic fine particles to be blended with the toner base particles may be used in an amount of from 0.01 to 5 parts by weight, and preferably from 0.01 to 3 parts by weight, based on 100 parts by weight of the toner base particles.

The toner of the present invention may preferably have a weight-average particle diameter (D4) of from 2.5 μm to 10.0 μm, more preferably from 5.0 μm to 9.0 μm, and still more preferably from 6.0 μm to 8.0 μm, where a sufficient effect can be brought out, as being preferable.

The weight-average particle diameter (D4) and particle size distribution of the toner are measured by a Coulter Counter method. For example, Coulter Multisizer (manufactured by Coulter Electronics, Inc.) may be used. As an electrolytic solution, a 1% NaCl aqueous solution is prepared using first-grade sodium chloride. For example, ISOTON R-II (available from Coulter Scientific Japan Co.) may be used. To make a measurement, as a dispersant 0.1 to 5 ml of a surface active agent (preferably an alkylbenzenesulfonate) is added to 100 to 150 ml of the above aqueous electrolytic solution, and 2 to 20 mg of a sample for measurement is further added. The electrolytic solution in which the sample has been suspended is subjected to dispersion for about 1 minute to about 3 minutes in an ultrasonic dispersion machine. The volume distribution and number distribution are calculated by measuring the volume and number of toner particles of 2.00 μm or more in diameter by means of the above measuring instrument, using an aperture of 100 μm. Then the weight-base, weight average particle diameter (D4) according to the present invention, determined from the volume distribution, is calculated. As channels, 13 channels are used, which are of 2.00 to less than 2.52 μm, 2.52 to less than 3.17 μm, 3.17 to less than 4.00 μm, 4.00 to less than 5.04 μm, 5.04 to less than 6.35 μm, 6.35 to less than 8.00 μm, 8.00 to less than 10.08 μm, 10.08 to less than 12.70 μm, 12.70 to less than 16.00 μm, 16.00 to less than 20.20 μm, 20.20 to less than 25.40 μm, 25.40 to less than 32.00 μm, and 32.00 to less than 40.30 μm.

The toner of the present invention may be used in combination with a carrier so as to be used as a two-component developer. As the carrier used in two-component development, a conventionally known carrier may be used. Stated specifically, usable as the carrier are particles which have an average particle diameter of from 20 μm to 300 μm and are formed of a metal such as iron, nickel, cobalt, manganese, chromium or a rare earth element, or an alloy or an oxide thereof, having been surface-oxidized or non-oxidized.

Preferred is a carrier on the particle surfaces of which a material such as a styrene resin, an acrylic resin, a silicone resin, a fluorine resin or a polyester resin has been deposited or coated.

To produce the toner according to the present invention, toner constituent materials as described above may be thoroughly mixed by means of a ball mill or any other mixing machine, followed by sufficient kneading using a heat kneading machine such as a heat roll, a kneader or an extruder. The kneaded product obtained is cooled to solidify, followed by crushing, thereafter fine grinding and then classification. Thereafter, the toner particles obtained may be subjected to surface modification by means of a surface modifying apparatus (e.g., FACULTY F-600, manufactured by Hosokawa Micron Corporation). Any desired additives may further optionally be mixed by means of a mixing machine such as Henschel mixer. Thus, the toner according to the present invention can be produced.

Figure 2:
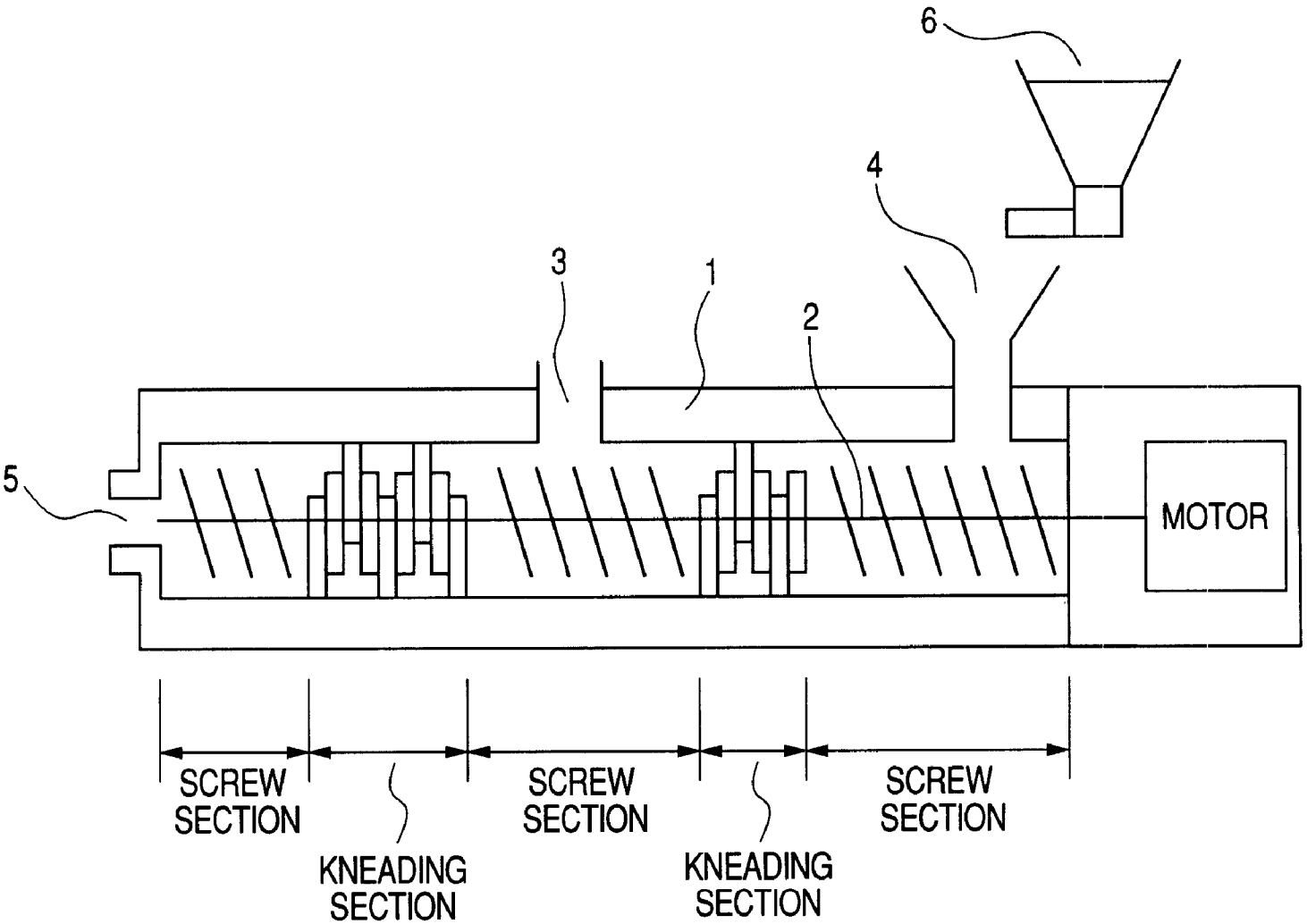
FIG. 2 is a schematic view of a kneading apparatus preferable in the present invention.
Figure 3:
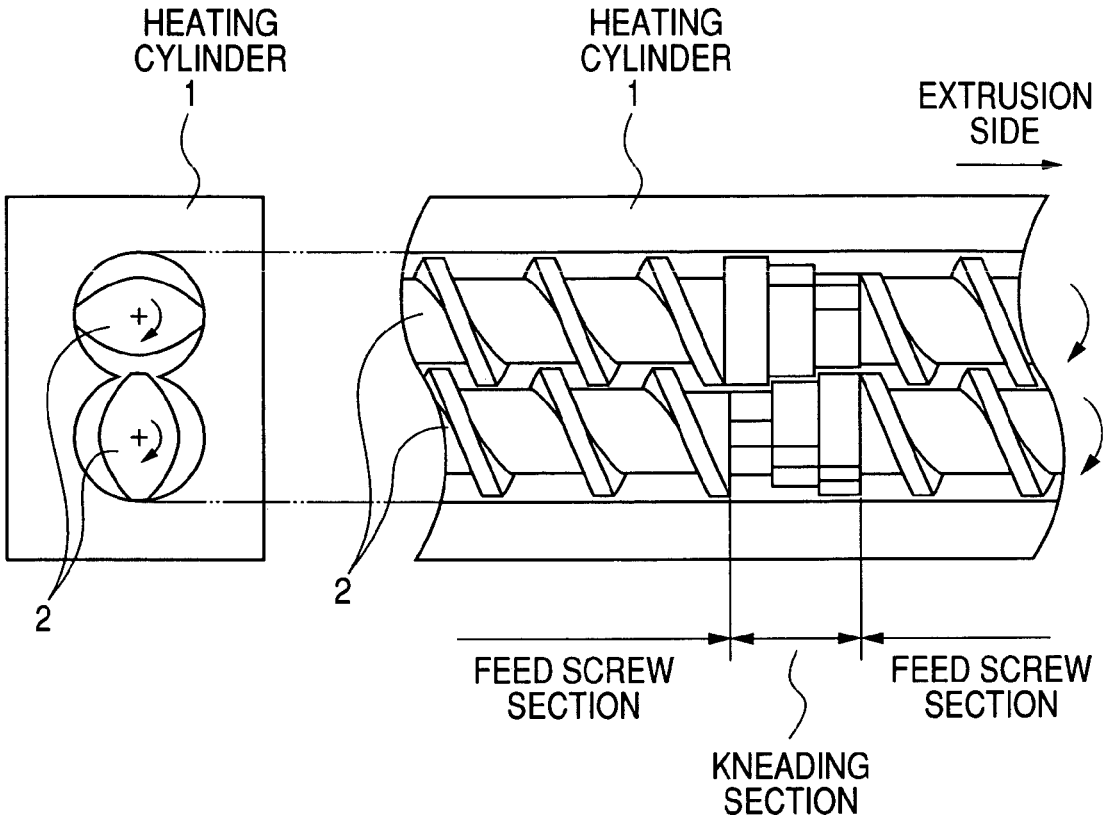
FIG. 3 is a detailed view of paddles in the kneading apparatus shown in FIG. 2.

Of the above production conditions, the step of melt kneading is an important step for making the gel formation that is characteristic of the present invention. FIG. 2 schematically illustrates a kneading apparatus (a twin-screw extruder) in the present invention, and FIG. 3 shows the details of paddles in the kneading apparatus shown in FIG. 2. The kneading apparatus has a heating cylinder 1, paddles 2, a vent hole 3, a feed opening 4, an extrusion opening 5 and a raw-material hopper. As shown in these drawings, the apparatus may preferably have kneading sections at two or more places. By passing materials through the kneading sections at two or more places, the kneaded product can be brought into a perfectly melted state, and an optimum gel can be formed and raw-materials can be dispersed in a good state.

Here, in order to obtain the toner of the present invention, it is preferable that a first kneading section on the side close to the feed opening 4 is set at a high temperature and a second kneading section on the side close to the extrusion opening 5 is set at a low temperature. It is particularly preferable that the difference in temperature between both the kneading sections is 10° C. or more. When setting up the apparatus in this way, the gel is placed in a larger spread so that the effect of the present invention can be more easily exhibited. That is, the gel spreads in the high-temperature first kneading section. In the low-temperature second kneading section, the gel becomes entangled while maintaining a certain spread. Thus, the gel characteristic of the present invention can more readily be formed.

In the twin-screw extruder, two rotating shafts called paddles are inserted in the heating cylinder 1, which keeps their temperature constant. Cooling water may be made to run through the inside of the rotating shafts (main-shaft cooling). Where the main-shaft cooling is carried out, a temperature difference is produced between the heating cylinder 1 and the paddles 2, and shear can be applied to toner materials to a certain extent. Hence, the density of entanglement of the gel can be made higher, which is more preferable in order to obtain the effects of the present invention.

As for production apparatus, the mixing machine may include, e.g., Henschel Mixer (manufactured by Mitsui Mining & Smelting Co., Ltd.); Super Mixer (manufactured by Kawata MFG Co., Ltd.); Conical Ribbon Mixer (manufactured by Y.K. Ohkawara Seisakusho); Nauta Mixer, Turbulizer, and Cyclomix (manufactured by Hosokawa Micron Corporation); Spiral Pin Mixer (manufactured by Pacific Machinery & Engineering Co., Ltd.); and Rhedige Mixer (manufactured by Matsubo Corporation). the kneading machine may include KRC Kneader (manufactured by Kurimoto, Ltd.); Buss-Kneader (manufactured by Coperion Buss Ag.); TEM-type Extruder (manufactured by Toshiba Machine Co., Ltd.); TEX Twin-screw Extruder (manufactured by The Japan Steel Works, Ltd.); PCM Kneader (manufactured by Ikegai Corp.); Three-Roll Mill, Mixing Roll Mill, and Kneader (manufactured by Inoue Manufacturing Co., Ltd.); Kneadex (manufactured by Mitsui Mining & Smelting Co., Ltd.); MS-type Pressure Kneader, and Kneader-Ruder (manufactured by Moriyama Manufacturing Co., Ltd.); and Banbury Mixer (manufactured by Kobe Steel, Ltd.). The grinding machine may include Counter Jet Mill, Micron Jet, and Inomizer (manufactured by Hosokawa Micron Corporation); IDS-type Mill, and PJM Jet Grinding Mill (manufactured by Nippon Pneumatic MFG Co., Ltd.); Cross Jet Mill (manufactured by Kurimoto, Ltd.); Ulmax (manufactured by Nisso Engineering Co., Ltd.); SK Jet O-Mill (manufactured by Seishin Enterprise Co., Ltd.); Criptron (manufactured by Kawasaki Heavy Industries, Ltd); Turbo Mill (manufactured by Turbo Kogyo Co., Ltd.); and Super Rotor (manufactured by Nisshin Engineering Inc.). As a classifier, it may include Classyl, Micron Classifier, and Spedic Classifier (manufactured by Seishin Enterprise Co., Ltd.); Turbo Classifier (manufactured by Nisshin Engineering Inc.); Micron Separator, Turboprex(ATP), and TSP Separator (manufactured by Hosokawa Micron Corporation); Elbow Jet (manufactured by Nittetsu Mining Co., Ltd.); Dispersion Separator (manufactured by Nippon Pneumatic MFG Co., Ltd.); and YM Microcut (manufactured by Yasukawa Shoji K.K.). As a sifter used to sieve coarse powder and so forth, it may include Ultrasonics (manufactured by Koei Sangyo Co., Ltd.); Rezona Sieve, and Gyro Sifter (manufactured by Tokuju Corporation); Vibrasonic Sifter (manufactured by Dulton Company Limited); Sonicreen (manufactured by Shinto Kogyo K.K.); Turbo-Screener (manufactured by Turbo Kogyo Co., Ltd.); Microsifter (manufactured by Makino mfg. co., ltd.); and circular vibrating screens.

For measuring the absolute molecular weight of ODCB-soluble matter in the toner, the intrinsic viscosity of the toner, the content of ODCB-insoluble matter of the toner, the molecular weight and molecular weight distribution of THF-soluble matter and the content of THF-insoluble matter of the resin, the molecular weight and molecular weight distribution of the wax, and so forth, the following methods are used.

(1) Measurement of Absolute Molecular Weight of ODCB-Soluble Matter by High-Temperature GPC-RALLS-viscometer Analysis:

(i) Pretreatment 0.2 g of the toner is put into a filtration container for exclusive use (e.g., a dissolution filtration container manufactured by Tosoh Corporation; pore size: 10 μm), and then put into a 15 ml test tube together with 10 ml of ODCB. This is dissolved at 150° C. for 12 hours, using a solution filter (e.g., DF-8020, manufactured by Tosoh Corporation). After 12 hours, analysis is made using the following instruments.

(ii) Analytical Conditions:

Instruments: HLC-8121GPC/HT (manufactured by Tosoh Corporation); DAWN EOS (manufactured by Wyatt Technology Corporation); and a high-temperature differential pressure viscosity detector (manufactured by Viscotek).

Columns: TSKgel GMHHR-H HT 7.8 cm I.D×30 $cm^2$, combination of two columns (available from Tosoh Corporation).

Detector 1: Multiple-angle light scattering detector, Wyatt DAWN EOS.

Detector 2: High-temperature differential pressure viscosity detector.

Detector 3: Blaise type dual flow differential diffractometer.

Temperature: 135° C.

Solvent: o-Dichlorobenzene (0.05% ionol-added).
Flow rate: 1.0 ml/min.
Injection amount: 300 μl.

In this measurement, the molecular weight distribution and intrinsic viscosity on the basis of absolute molecular weight are directly outputted, and the measurement theory is as follows:

Measurement Theory $$M_{90}=R(\theta_{90})/KC \text{ . . . Rayleigh equation.}$$

$M_{90}$: Molecular weight at 90° C.
$R(\theta_{90})$: Rayleigh ratio at a scattering angle of 90° C.
K: Optical constant ($=2\pi^2n^2/\lambda_0{}^4N_A\cdot(dn/dc)^2$).
C: Solution concentration.

$$Rg=(1/6)^{1/2}\,([\theta]M_{90}/(\Phi)^{1/3} \text{ . . . Flory Fox equation.}$$

Rg: Radius of inertia.
η: Intrinsic viscosity.
Φ: Shape factor.
Absolute molecular weight: $M=R(\theta_0)/KC$.
$R(\theta 0)=R(\theta_{90})/P(\theta_{90})$.
$P(\theta_{90})=2/X^2\cdot(e^{-X}-(1-X))(X=4\pi n/\lambda\cdot R_g)$
λ: Wavelength.
(dn/dc): Herein set at 0.068 ml/g.

(2) Content of ODCB-Insoluble Matter in Toner:

2.0 g of the toner is weighed, which is then put into a cylindrical filter paper (e.g., No. 86R, with a size of 20 mm×90 mm, available from Toyo Roshi K.K.) and set in an eggplant type flask to the upper part of which a condenser is connected. Extraction is carried out at 185° C. for 6 hours using 200 ml of o-dichlorobenzene (ODCB) as a solvent. After the extraction is completed, the cylindrical filter paper is taken out, and then vacuum-dried at 150° C. for 8 hours, where the extraction residue is weighed. The insoluble matter is expressed by:

$$(W3/W1)\times 100 \text{ (\% by weight)}$$

wherein the weight of the resin component introduced first is represented by W1 g, and the weight of the resin component in the extraction residue is represented by W3 g.

The weight (W1) of the resin component in the toner is, in the case of a magnetic toner, the weight found by subtracting the weight of ODCB-insoluble matter other than the resin, such as the magnetic material, the pigment and the wax, from the weight of the sample toner, and in the case of a non-magnetic toner, is the weight found by subtracting the weight of ODCB-insoluble matter other than the resin, such as the pigment, from the weight of the sample toner. Also, the weight (W3) of the resin component in the extraction residue is the weight found by subtracting the weight of ODCB-insoluble matter other than the resin, such as the magnetic material, the pigment and the wax, from the weight of the extraction residue. Using these values, the content of ODCB-insoluble matter can be calculated according to the above expression.

(3) Measurement of Molecular Weight of THF-Soluble Matter of Resin:

Molecular weight on a chromatogram by gel permeation chromatography (GPC) is measured under the following conditions.

Columns are stabilized in a heat chamber of 40° C. To the columns kept at this temperature, tetrahydrofuran (THF) as a solvent is flowed at a flow rate of 1 ml per minute. The resin having been dispersed in THF is left for 24 hours, followed by filtration with a filter of 0.2 μm in pore size, and the resultant filtrate is used as a sample. Then, 50 to 200 μl of a THF solution of resin which has been adjusted to have a sample concentration of from 0.05 to 0.6% by weight is injected to make a measurement. In measuring the molecular weight of the sample, the molecular weight distribution of the sample is calculated from the relationship between the logarithmic value on a calibration curve prepared using several kinds of monodisperse polystyrene standard samples and the count number. As the standard polystyrene samples used for the preparation of the calibration curve, it is suitable to use samples with molecular weights of 600, 2,100, 4,000, 17,500, 51,000, 110,000, 390,000, 860,000, 2,000,000 and 4,480,000, which are available from Pressure Chemical Co. or Tosoh Corporation, and using at least about 10 standard polystyrene samples. An RI (refractive index) detector is used as a detector.

As columns, in order to make a precise measurement in the molecular weight region of from 1,000 to 2,000,000, it is desirable to use a plurality of commercially available polystyrene gel columns in combination. For example, preferred is the use of a combination of Shodex GPC KF-801, KF-802, KF-803, KF-804, KF-805, KF-806 and KF-807, available from Showa Denko K.K.

(4) Content of THF-Insoluble Matter of Resin:

The resin is weighed, then put into a cylindrical filter paper (e.g., No. 86R, with a size of 28 mm×10 mm, available from Toyo Roshi K.K.) and set on a Soxhlet extractor. Extraction is carried out for 16 hours using 200 ml of THF as a solvent. At this point, extraction is carried out at such a reflux speed that the extraction cycle of the THF is one time per about 4 to 5 minutes. After the extraction is completed, the cylindrical filter paper is taken out, and then the extraction residue is weighed to obtain the insoluble matter of the resin. The insoluble matter is expressed by:

$$(W3/W1)\times 100 \text{ (\% by weight)}$$

where the weight of the resin component introduced first is represented by W1, and the weight of the resin component in the extraction residue is represented by W3 g.

(5) Acid Value of THF-Soluble Matter of Toner and that of Raw-Material Binder Resin:

In the present invention, the acid value (JIS acid value) of THF-soluble matter of toner and that of raw-material binder resin are determined by the following method. The acid value of the raw-material binder resin is also meant to be the acid value of THF-soluble matter of the raw-material binder resin.

Basic operation is carried out according to JIS K 0070.

1) The toner and the raw-material binder resin from which the THF-insoluble matter has been removed, or the soluble component obtained in the above measurement of THF-insoluble matter, which has been extracted with the THF solvent by means of the Soxhlet extractor, is used as a sample. 0.5 g to 2.0 g of a crushed product of the sample is precisely weighed, and the weight of the soluble component is represented by W (g).
2) The sample is put into a 300 ml beaker, and 150 ml of a toluene/ethanol (4/1) mixed solvent is added thereto to dissolve the sample.
3) Using a 0.1 mol/l KOH ethanol solution, titration is made by means of a potentiometric titrator (for example, automatic titration may be utilized which is made using a potentiometric titrator AT-400 (WIN WORKSTATION) and an ABP-410 motor buret, manufactured by Kyoto Electronics Manufacturing Co., Ltd.).
4) The amount of the KOH solution used in the titration is represented by S (ml). A blank test using no sample is conducted at the same time, and the amount of the KOH solution used in the blank test is represented by B (ml).

5) The acid value is calculated according to the following expression. "f" is the factor of KOH. Acid value (mg·KOH/g)={(S−B)×f×5.61}/W.

(6) Glass Transition Temperature (Tg) of Toner:

The glass transition temperature (Tg) of the resin is measured according to ASTM D3418-82, using a differential scanning calorimeter (DSC measuring instrument) DSC-7 (manufactured by Perkin-Elmer Corporation), DSC2920 (manufactured by TA Instruments Japan Ltd.), DSC Q-1000 (manufactured by TA Instruments Japan Ltd.) or the like.

A sample for measurement is precisely weighed in an amount of 5 mg to 20 mg, and preferably 10 mg. This sample is put into an aluminum pan and an empty aluminum pan is used as reference. Measurement is made in a normal-temperature and normal-humidity environment (25° C./60% RH) at a heating rate of 10° C./min within the measurement range of from 30° C. to 200° C. In this temperature rise process, a change of the specific heat is measured. The intersection of i) the center line between the base lines of the differential thermal curve before and after the occurrence of a change of the specific heat within the temperature range of from 40° C. to 100° C. and ii) the differential thermal curve is regarded as the glass transition temperature (Tg).

(7) Measurement of Epoxy Value:

Basic operation is made according to JIS K 7236.

1) 0.5 g to 2.0 g of a sample is precisely weighed, and the amount is represented by W (g).
2) The sample is put into a 300 ml beaker, and is dissolved in a mixture of 10 ml of chloroform and 20 ml of acetic acid.
3) To the solution obtained in the step 2), 10 ml of tetraethylammonium bromide acetic acid solution (prepared by dissolving 100 g of tetraethylammonium bromide in 400 ml of acetic acid) is added. Using a 0.1 mol/l perchloric acid acetic acid solution, titration is made by means of a potentiometric titrator (for example, automatic titration may be utilized which is made using a potentiometric titrator AT-400 (WIN WORKSTATION) and an ABP-410 motor buret, manufactured by Kyoto Electronics Manufacturing Co., Ltd.). The amount of the acetic acid solution of perchloric acid used here is represented by S (ml). A blank using no sample is measured at the same time, and the amount of the acetic acid solution of perchloric acid used in this blank is represented by B (ml). The epoxy value is calculated according to the following expression. "f" is the factor of acetic acid solution of perchloric acid.

$$\text{Epoxy value (eq/kg)}=\{0.1\times f\times(S-B)\}/W.$$

(8) Measurement of Molecular Weight Distribution of Wax:

In the present invention, the molecular weight distribution of the wax is measured by gel permeation chromatography (GPC) under the following conditions.

GPC Measuring Conditions

Apparatus: HLC-8121GPC/HT (manufactured by Tosoh Corporation).

Columns: TSKgel GMHHR-H HT 7.8 cm I.D×30 cm, combination of two columns (available from Tosoh Corporation).

Detector: RI for high temperature.

Temperature: 135° C.

Solvent: o-Dichlorobenzene (0.05% ionol-added).

Flow rate: 1.0 ml/min.

Sample: 0.4 ml of 0.1% sample is injected.

Molecular weight is measured under the conditions shown above. The molecular weight of the sample is calculated using a molecular weight calibration curve prepared from a monodisperse polystyrene standard sample, and converted in terms of polyethylene according to a conversion equation derived from the Mark-Houwink viscosity equation.

(9) Measurement of Acid Value, Hydroxyl Value, Ester Value and Saponification Value of Wax:

In the present invention, the acid value, hydroxyl value, ester value and saponification value of the wax are determined by the following methods. Basic operation is made according to JIS K 0070.

Measurement of Acid Value

Implements and tools:

Erlenmeyer flask (300 ml).

Buret (25 ml).

Water bath or hot plate.

Reagents:

0.1 mol/l Hydrochloric acid.

0.1 mol/l Potassium hydroxide ethanol solution. (To make standardization, 25 ml of the 0.1 mol/l hydrochloric acid is taken in an Erlenmeyer flask by using a transfer pipet, and a phenolphthalein solution is added to carry out titration with the 0.1 mol/l potassium hydroxide ethanol solution. The factor is determined from the amount required for neutralization.)

Phenolphthalein solution solvent. (A mixed solvent of diethyl ether and ethanol (99.5) in a volume ratio of 1:1 or 2:1. These are neutralized with the 0.1 mol/l potassium hydroxide ethanol solution, adding a few drops of a phenolphthalein solution as an indicator immediately before use.

Measuring Method:

(a) 1 to 20 g of the wax is precisely weighed in the Erlenmeyer flask.

(b) 100 ml of the solvent and a few drops of the phenolphthalein solution as an indicator are added, and these are thoroughly mixed by shaking until the wax dissolves completely on the water bath.

(c) Titration is carried out using the 0.1 mol/l potassium hydroxide ethanol solution, and the point of time from which the pale red color of the indicator has continued for 30 seconds is regarded as the end point.

Calculation:

Calculation is carried out according to the following equation:

$$A=(5.611\times B\times f)/S$$

where;

A is the acid value (mg·KOH/g);

B is the amount (ml) of the 0.1 mol/l potassium hydroxide ethanol solution used;

f is the factor of the 0.1 mol/l potassium hydroxide ethanol solution;

S is the weight (g) of the wax; and 5.611 is the value of (formular weight 56.11 of potassium hydroxide)×1/10.

Measurement of Hydroxyl Value

Implements and tools:

Measuring cylinder (100 ml).

Transfer pipet (5 ml).

Flat-bottom flask (200 ml).

Glycerol bath.

Reagent:

Acetylating reagent. (25 g of acetic anhydride is taken in the 100 ml measuring cylinder, and pyridine is added to make up a 100 ml solution in total weight, followed by thorough shaking.)

Phenolphthalein Solution.

0.5 mol/l Potassium hydroxide ethanol solution.

Measuring Method:

(a) 0.5 to 6.0 g of the wax is precisely weighed in the flat-bottom flask, and 5 ml of the acetylating reagent is added thereto using the transfer pipet.

(b) A small funnel is placed at the mouth of the flask, and its bottom is immersed by about 1 cm in a temperature 95° C. to 100° C. glycerol bath and heated. In order to prevent the neck of the flask from being heated by the heat of the glycerol bath, the base of the neck of the flask is covered with a cardboard disk with a round hole made in the middle.

(c) After 1 hour, the flask is taken out of the glycerol bath. After it was left standing for cooling, 1 ml of water is added through the funnel, followed by shaking to decompose acetic anhydride.

(d) In order to further effect the decomposition completely, the flask is again heated in the glycerol bath for 10 minutes. After it was left standing for cooling, the walls of the funnel and flask are washed with 5 ml of ethanol (95%).

(e) A few drops of the phenolphthalein solution is added as an indicator, followed by titration with the 0.5 mol/l potassium hydroxide ethanol solution, and the point of time from which the pale red color of the indicator has continued for 30 seconds is regarded as the end point.

(f) As an empty test, the procedures (a) to (e) are repeated without adding any wax.

(g) In the case where the sample does not readily dissolve, pyridine is added in a small quantity, or xylene or toluene is added, dissolving the sample.

Calculation:

Calculation is carried out according to the following equation:

$$A=[\{(B-C)\times 28.05\times f\}/S]+D$$

where;

A is the hydroxyl value (mg·KOH/g);

B is the amount (ml) of the 0.5 mol/l potassium hydroxide ethanol solution used in the empty test;

C is the amount (ml) of the 0.5 mol/l potassium hydroxide ethanol solution used in the titration;

f is the factor of the 0.5 mol/l potassium hydroxide ethanol solution;

S is the weight (g) of the wax; and 28.05 is the value of (formular weight 56.11 of potassium hydroxide)×½.

Measurement of Ester Value

Calculation is carried out according to the following equation:

$$\text{Ester Value}=(\text{saponification Value})-(\text{acid value}).$$

Measurement of Saponification Value

Implements and tools:

Erlenmeyer flask (200 to 300 ml).

Air condenser. (A glass tube of 6 to 8 mm in outer diameter and 100 cm in length or a reflux condenser, either of which is of a ground-in type connectable to the mouth of the Erlenmeyer flask.)

Buret (50 ml).

Transfer pipet (25 ml).

Water bath, sand bath or hot plate (which is controllable to a temperature of about 80° C.)

Reagents:

0.5 mol/l hydrochloric acid.

0.5 mol/l Potassium hydroxide ethanol solution.

Phenolphthalein Solution.

Measuring Method:

(a) 1.5 to 3.0 g of the wax is precisely weighed in the Erlenmeyer flask up to the order of 1 mg.

(b) 25 ml of the 0.5 mol/l potassium hydroxide ethanol solution is added thereto using the transfer pipet.

(c) The air condenser is attached to the

Erlenmeyer flask, and the reaction is carried out with gentle heating on the water bath, sand bath or hot plate for 30 minutes while its contents are mixed by shaking it sometimes. When heated, the heating temperature is so controlled that the ring of ethanol being refluxed does not reach the top of the air condenser.

(d) After the reaction is completed, the contents are immediately cooled, and, before they harden in the form of agar, water or a xylene:ethanol 1:3 mixed solvent are sprayed in a small quantity over the air condenser to wash its inner wall. Thereafter, the air condenser is detached.

(e) 1 ml of the phenolphthalein solution is added as an indicator, followed by titration with the 0.5 mol/l hydrochloric acid, and the point of time from which the pale red color of the indicator does not appear for 1 minute is regarded as the end point.

(f) As an empty test, the procedures (a) to (e) are repeated without adding any wax.

(g) In the case where the sample does not readily dissolve, xylene or a xylene-ethanol mixed solvent is added to dissolve the sample.

Calculation:

Calculation is carried out according to the following equation:

$$A=\{(B-C)\times 28.05\times f\}/S$$

where;

A is the saponification value (mg·KOH/g);

B is the amount (ml) of the 0.5 mol/l hydrochloric acid used in the empty test;

C is the amount (ml) of the 0.5 mol/l hydrochloric acid used in the titration;

f is the factor of the 0.5 mol/l hydrochloric acid;

S is the weight (g) of the wax; and 28.05 is the value of (formular weight 56.11 of potassium hydroxide)×½.

In measuring the acid value, hydroxyl value, ester value and saponification value of the wax contained in the toner in the present invention, the wax may be separated from the toner and thereafter the measurement may be made according to the above measuring methods.

EXAMPLES

The fundamental constitution and characteristic features of the present invention have been described above. In the following, the present invention is described in greater detail by giving Examples. However, they should not be construed to limit embodiments of the present invention.

Waxes (a) and (b) used in Examples and Comparative Example are shown in Tables 1 and 2. Resin production processes are shown below. The results of measurement by DSC of the wax (a) are shown in FIG. 1.

Production Example A-1 of High-Molecular Weight Component

| | (by weight) |
|---|---|
| Styrene | 80.0 parts |
| n-Butyl acrylate | 18.0 parts |
| Methacrylic acid | 2.0 parts |
| 2,2-Bis(4,4-di-t-butylperoxycyclohexyl)propane | 0.8 part |

In a four-necked flask, while stirring 200 parts by weight of xylene, the inside of the container was sufficiently displaced with nitrogen and was heated to 120° C., and thereafter the above materials were dropwise added over a period of 4 hours. Further, with retention for 10 hours under reflux of xylene, polymerization was completed, and the solvent was evaporated away under reduced pressure. The resin thus obtained is designated as High-Molecular Weight Component A-1. Physical properties of the resin obtained are shown in Table 3.

Production Examples A-2 to A-4 of High-Molecular Weight Component

High-Molecular Weight Components A-2 to A-4 were obtained in the same manner as in Production Example A-1 except that the material formulation in Production Example A-1 was changed as shown in Table 3.

Production Example B-1 of Vinyl Resin Having Carboxyl Group

| | (by weight) |
|---|---|
| High-Molecular Weight Component A-1 | 30 parts |
| Styrene | 56.5 parts |
| n-Butyl acrylate | 12.8 parts |
| Methacrylic acid | 0.7 part |
| Di-tert-butyl peroxide | 1.4 parts |

200 parts by weight of xylene was introduced into an autoclave, and nitrogen gas was fed into it to sufficiently carry out deaeration. Next, this vessel was sealed, followed by heating to 200° C. Keeping this temperature, among materials in the above formulation, compounds other than High-Molecular Weight Component A-1 were dropwise added into the xylene over a period of 4 hours. Further, with retention under reflux of xylene for 1 hour, polymerization was completed. Then, High-Molecular Weight Component A-1 was added to the xylene solution, and these were thoroughly mixed to prepare a resin solution containing Resin B-1. Physical properties of Resin B-1 are shown in Table 4.

Production Examples B-2 to B-5 of Vinyl Resin Having Carboxyl Group

Resin solutions containing respectively Resins B-2 to B-5 were obtained in the same manner as in Production Example B-1 except that in Production Example B-1 the formulation was changed as shown in Table 4. Physical properties of Resins B-2 to B-5 are shown in Table 4.

Production Example B-6 of Vinyl Resin Having No Carboxyl Group

A resin solution containing Resin 6 was obtained in the same manner as in Production Example B-1 except that in Production Example B-1 the formulation was changed as shown in Table 4. Physical properties of Resin 6 are shown in Table 4.

Production Example C-1 of Vinyl Resin Having Epoxy Group

| | (by weight) |
|---|---|
| Styrene | 76.2 parts |
| n-Butyl acrylate | 18.0 parts |
| Glycidyl methacrylate | 5.6 parts |
| Di-t-butyl peroxide | 5.0 parts |

200 parts by weight of xylene was introduced into an autoclave, and nitrogen gas was fed into it to sufficiently carry out deaeration. Next, this vessel was sealed, followed by heating to 170° C. Keeping this temperature, the above materials were dropwise added over a period of 4 hours. Further, under reflux of xylene, polymerization was completed to prepare a resin solution containing Resin C-1. Physical properties of Resin C-1 are shown in Table 5.

Production Examples C-2 and C-3 of Vinyl Resin Having Epoxy Group

Resin solutions containing respectively Resins C-2 and C-3 were obtained in the same manner as in Production Example C-1 except that in Production Example C-1 the formulation was changed as shown in Table 5. Physical properties of Resins C-2 and C-3 are shown in Table 5.

Binder Resin Production Example 1

The solution of Vinyl Resin B-1 Having Carboxyl Group (containing 90 parts by weight of resin component) was put into an autoclave, and nitrogen gas was fed into it to sufficiently carry out deaeration. Next, this vessel was sealed, followed by heating to 160° C., and the solution of Vinyl Resin C-1 Having Epoxy Group (containing 5 parts by weight of resin component) was added, where the reaction was carried out for 2 hours. Thereafter, the temperature was raised to 180° C., and the solution of Vinyl Resin C-1 Having Epoxy Group (containing 5 parts by weight of resin component) was further added, where the reaction was carried out for 4 hours. Then, the temperature was dropped at a cooling rate of 1° C./min to 150° C., and kept for 4 hours. Then, the temperature was dropped to room temperature (at a cooling rate of 1° C./min), and the reaction was completed, and then, the solvent was evaporated away under reduced pressure to obtain Binder Resin 1. (Reaction Condition i)

Physical properties of this resin are shown in Table 6. In addition, the melting point of Binder Resin 1 obtained was 140° C.

Binder Resin Production Examples 2 to 9

Binder Resins 2 to 9 were obtained in the same manner as in Binder Resin Production Example 1 except that the resins and reaction conditions were changed as shown in Table 6. Here, Reaction Conditions ii and iii refer to the following conditions.

(Reaction Conditions ii)

Each solution of Vinyl Resin B Having Carboxyl Group was put into an autoclave, and nitrogen gas was fed into it to sufficiently carry out deaeration. Next, this vessel was sealed, followed by heating to 180° C., and each solution of Vinyl Resin C Having Epoxy Group was added (not added in Binder Resin 9), where the reaction was carried out for 6 hours. Thereafter, the temperature was dropped to room temperature at a cooling rate of 1° C./min, and the reaction was completed. Then, the solvent was evaporated away under reduced pressure to obtain binder resins. The components and the addition amount ratios thereof are shown in Table 6. In addition, the solution of each of Resins B and C was used in an amount that satisfies the B/C proportion shown in Table 6.

(Reaction Conditions iii)

90 parts by weight of Vinyl Resin B Having Carboxyl Group from which solvents have been removed and 20 parts by weight of solvent-removed Vinyl Resin C Having Epoxy Group from which solvents have been removed were mixed by means of Henschel mixer, then kneaded at 160° C. using a twin-screw extruder, followed by cooling and thereafter pulverization to produce a binder resin.

Example 1

| | (by weight) |
|---|---|
| Binder Resin 1 | 102 parts |
| Spherical magnetic iron oxide (average particle diameter: 0.21 μm; magnetic properties in a magnetic field of 79.58 kA/m (1 kOe), σr: 5.1 $Am^2/kg$ and σs: 69.6 $Am^2/kg$) | 95 parts |
| Wax (a-1) | 2 parts |
| Wax (b-1) | 5 parts |
| Negative charge control agent (iron azo compound T-77, available from Hodogaya Chemical Co., Ltd.) | 2 parts |

The above materials were preliminary mixed by means of Henschel mixer, and then melt-kneaded by means of the twin-screw kneader as shown in FIG. 2, while the main-shaft cooling was carried out, at a heating temperature of 130° C. for the first kneading section, at a heating temperature of 110° C. for the second kneading section and at the revolution of 200 rpm for the paddles (Kneading Conditions 1). The kneaded product was cooled and crushed by means of a hammer mill to obtain a toner material crushed product. The crushed product was finely pulverized by using a mechanical grinding machine Turbo Mill [manufactured by Turbo Kogyo Co., Ltd.; the surfaces of its rotor and stator were coated with chromium-carbide-containing chromium alloy plating (plating thickness: 150 μm; surface hardness: HV 1,050)]. The finely pulverized product thus obtained was classified by means of a multi-division classifier utilizing the Coanda effect (Elbow Jet Classifier, manufactured by Nittetsu Mining Co., Ltd.) to classify and remove fine powder and coarse powder at the same time to produce toner particles (toner base particles).

100 parts by weight of this toner base particles and 1.2 parts by weight of hydrophobic fine silica powder having been treated with hexamethyldisilazane and then with dimethylsilicone oil were blended by means of Henschel mixer to prepare negatively chargeable Toner 1, the physical properties of which were measured The physical properties of the toner are shown in Table 7.

Example 2

Toner 2 was prepared in the same manner as in Toner 1 except that the binder resin was changed as shown in Table 7. The physical properties of Toner 2 were measured in the same manner as in Example 1. Results obtained are shown in Table 7.

Example 3

Toner 3 was prepared in the same manner as Toner 1 except that the binder resin used was changed as shown in Table 7, and the kneading was carried out without the main-shaft cooling and at a heating temperature of 110° C. for the first kneading section, at a heating temperature of 130° C. for the second kneading section and at the revolution of 200 rpm for the paddles (Kneading Conditions 2). The physical properties of Toner 3 were measured in the same manner as in Example 1. Results obtained are shown in Table 7.

Examples 4 to 6

Toners 4 to 6 were prepared in the same manner as in Toner 1 except that the binder resin and the wax were changed as shown in Table 7, and the kneading was carried out without the main-shaft cooling and at a heating temperature of 130° C. for both the first kneading section and the second kneading section and at the revolution of 200 rpm for the paddles (Kneading Conditions 3). The physical properties of Toners 4 to 6 were measured in the same manner as in Example 1. Results obtained are shown in Table 7.

Comparative Examples 1 to 5

Toners 7 to 11 were prepared in the same manner as in Toner 1 except that the binder resin and the wax were as shown in Table 7 and the kneading conditions were changed to Kneading Conditions 3. The physical properties of Toners 7 to 11 were measured as in the same manner as in Example 1. Results obtained are shown in Table 7.

Next, using the toners thus prepared, evaluation was made by such methods as shown below. The evaluation results are shown in Table 8.

(Evaluation Machine)

Evaluation was made in the following way, using a laser beam printer LASER JET 4300n, manufactured by Hewlett-Packard Co.

Low-temperature fixing performance, high-temperature anti-offset properties:

The toner was put into a process cartridge, and evaluation was made using the commercially available printer LASER JET 4300n, manufactured by Hewlett-Packard Co., which was so modified that its fixing assembly was detached and the surface temperature of its fixing roller could be changed from 120° C. to 250° C. on the outside by means of a fixing tester fitted with an extern-1 drive and a fixing assembly temperature control unit and further that the print speed was set at 1.2 times.

(1) Low-Temperature Fixing Performance:

In a 15° C. temperature and 10% humidity environment, a solid black image was formed on Premium Multipurpose 4024 Paper (available from Xerox Corporation). This image-formed paper was doubled up and was passed through the above fixing assembly not heated. Further, the image-formed paper was unfolded, and folded in the opposite direction, which was then passed through the external fixing assembly. Before and after such a folding test, the image was rubbed back and forth five times at the middle of the fold line, with Silbon paper under the application of a load of 4.9 kPa. The rate (%) of a decrease in image density before and after the rubbing was measured, and the lowest temperature at which the decrease rate was 10% or less was regarded as fixing temperature (° C.).

(2) High-Temperature Anti-Offset Properties:

An image was printed in which the upper half of the image is comprised of a 100 μm wide horizontal-line pattern (100 μm in width and 100 μm in interval) and solid black and the lower half of the image is white, and the maximum temperature at which no stain appear on the white image was checked. Copying machine plane paper on which the offset tends to occur (60 g/m$^2$ in basis weight) was used as test paper.

(3) Anti-Blocking Properties:

10 g of the toner was weighed out in a polypropylene cup, and the surface was flattened out. Thereafter, powdered-medicine wrapping paper was spread thereon and 10 g of an iron powder carrier was further placed thereon, and was left standing for 5 days in a 50° C. and 0% RH environment. evaluating the blocking state of the toner.

A: The toner flows smoothly when the cup is inclined.

B: While the cup is turned, the toner surface begins to crumble little by little into smooth powder.

C: The toner surface crumbles upon applying force from the outside while the cup is turned, and the toner begins to flow smoothly before long.

D: Blocking balls occur. They crumble when poked with something sharp.

E: Blocking balls occur. They can not easily crumble even when poked.

(4) Image Density, Fog:

Using the laser beam printer LASER JET 4300n, manufactured by Hewlett-Packard Co., (A4, 45 sheets/minute; process speed: 256 m/sec.) and in each environment of a low-temperature and low-humidity environment (15° C./10% RH) and a high-temperature and high-humidity environment (32.5° C./80% RH), a 4,500-sheet image reproduction test was conducted at a print speed of 1 sheet/10 seconds, at a print percentage of 5% and on copying machine plain paper (A4 size, 75 g/m$^2$ in basis weight). After leaving the printer for one day in the testing room environment, the 4,500-sheet image reproduction test was again conducted. This was repeated until the image reproduction test was conducted on 18,000 sheets in total.

The image density was measured with Macbeth Reflection Densitometer (manufactured by Macbeth Co.), as relative density with respect to an image printed on a white background area with a density of 0.00 of an original.

The fog was calculated from a difference between the whiteness of a transfer sheet and the whiteness of the transfer sheet after printing solid white, as measured with a reflectometer manufactured by Tokyo Denshoku Co., Ltd.

Figure 4:
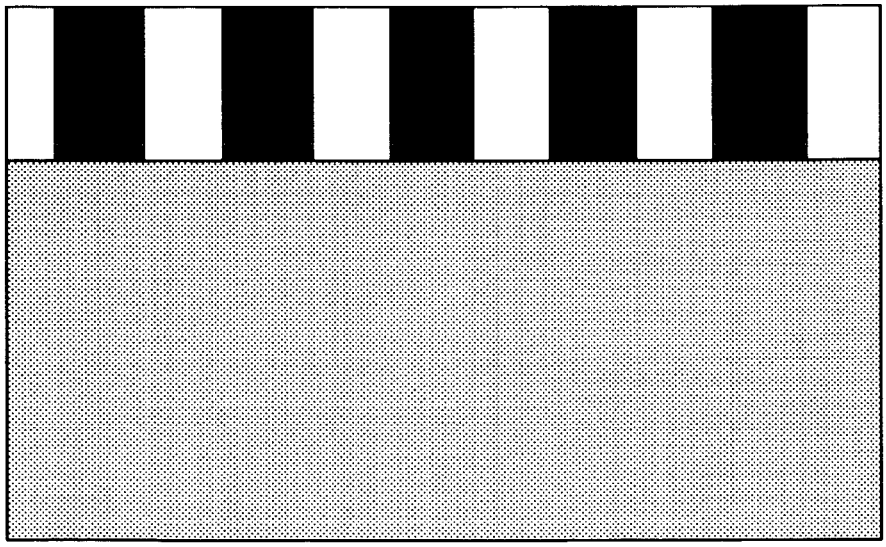
FIG. 4 illustrates a pattern used to make an evaluation on sleeve ghost.

(5) Sleeve Negative Ghost:

Images were printed on 18,000 sheets of usual copying machine plain paper (A4 size, 75 g/m$^2$ in basis weight) in a low-temperature and low-humidity environment (15° C./10% RH). Evaluation was made on sleeve negative ghosts at intervals of 4,500 sheets. For image evaluation in regard to ghosts, solid black stripes were reproduced for only one round of the sleeve and then a halftone image was reproduced. The pattern used in the reproduction is schematically illustrated in FIG. 4. As an evaluation method, on a sheet of printed images, the difference in reflection density measured with the Macbeth reflection densitometer on the second round of the sleeve between a place where the solid black images were formed (black printed areas) on the first round and a place where they were not formed (non-image areas), was calculated as shown below. The negative ghost is a ghost phenomenon in which, usually on images appearing on the second round of the sleeve, the image density at the portion assigned to black printed areas on the first round of the sleeve is lower than the image density at the portion assigned to non-image areas on the first round of the sleeve, and the shape of the pattern reproduced on the first round appears as it is. Evaluation was made by measuring such a density difference, i.e., reflection density difference.

Reflection density difference=(reflection density at a place where no image is formed)−(reflection density at a place where images are formed).

The smaller the difference in reflection density is, the less the ghosts appear, showing a better level. As overall evaluation of the ghosts, evaluation was made according to four ranks of A, B, C and D. The worst evaluation result in the evaluation at intervals of 4,500 sheets is shown.

A: Reflection density difference is less than 0.02.

B: Reflection density difference is 0.02 or more to less than 0.04.

C: Reflection density difference is 0.04 or more to less than 0.06.

D: Reflection density difference is 0.06 or more.

(6) Spots Around Line Images:

In the running test in the low-temperature and low-humidity environment, a lattice pattern with 100 μm (latent image) lines (1 cm in interval) was printed at the initial stage and on the 18,000th sheet, and spots around line images were visually inspected with an optical microscope for the evaluation.

A: Lines are very sharp and spots around line images are little seen.

B: A level such that spots around line images are slightly seen, and lines are relatively sharp.

C: Spots around line images a little many appear, and lines look vague.

D: a level lower than C.

TABLE 1

| | Hydrocarbon Wax (a) | | | | | | | | |
|---|---|---|---|---|---|---|---|---|---|
| | Type | Number = average molecular weight | Weight = average molecular weight | Onset temp. (° C.) | Main Peak temp. (° C.) | Viscosity at 120° C. (mPa · s) | Hydroxyl value (mg · KOH/g) | Ester value (mg · KOH/g) | Acid value (mg · KOH/g) |
| (a)-1 | Fischer = Tropsch wax | 1,560 | 1,700 | 66 | 105 | 20 | 0.0 | 0.0 | 0.0 |
| (a)-2 | Fischer = Tropsch wax | 1,350 | 1,400 | 53 | 90 | 14 | 0.2 | 0.1 | 0.1 |
| (a)-3 | Polypropy-lene wax | 4,600 | 8,600 | 124 | 140 | 46 | 0.2 | 0.2 | 0.1 |

TABLE 2

| | Hydrocarbon Wax (b) | | | | | | | | |
|---|---|---|---|---|---|---|---|---|---|
| | Partial structural formulas | Number = average molecular weight | Weight = average molecular weight | Main Peak temp. (° C.) | Hydroxyl value (mg · KOH/g) | Ester value (mg · KOH/g) | Acid value (mg · KOH/g) | Viscosity at 120° C. (mPa · s) | Penetration |
| (b)-1 | (A), (B), (C), (D) | 610 | 615 | 77 | 66.0 | 10.0 | 9.0 | 5.0 | 7 |
| (b)-2 | (A), (B), (C), (D) | 1800 | 2200 | 121 | 15.1 | 4.8 | 4.2 | 26.5 | 2 |
| (b)-3 | (A), (B), (C), (D) | 550 | 610 | 70 | 133.7 | 31.3 | 17.6 | 3.5 | 8 |

TABLE 3

| High-Molecular Weight Component: | Formulation St | BA | MA | AA | BPCP | GPC Mw | Mn | Peak | Acid value (mg · KOH/g) |
|---|---|---|---|---|---|---|---|---|---|
| | (parts by weight) | | | | | | | | |
| A-1 | 80.0 | 18.0 | 2.0 | — | 0.8 | 320,000 | 82,000 | 250,000 | 13.1 |
| A-2 | 82.0 | 13.2 | 4.8 | — | 0.7 | 370,000 | 92,000 | 280,000 | 31.2 |
| A-3 | 78.0 | 21.5 | — | 0.5 | 1.0 | 260,000 | 64,000 | 170,000 | 3.9 |
| A-4 | 86.5 | 13.5 | — | — | 0.6 | 370,000 | 110,000 | 290,000 | 0.0 |

St: Styrene;
BA: n-Butyl acrylate;
MA: Methacrylic acid;
AA: Acrylic acid
BPCP: 2,2-Bis(4,4-di-t-butyl peroxycyclohexyl)propane

TABLE 4

| | Physical Properties of Vinyl Resin Having Carboxyl Group | | | | | | | | | | | |
|---|---|---|---|---|---|---|---|---|---|---|---|---|
| | Formulation | | | | | | GPC | | | | | |
| Resin: | High = molecular weight component | St | BA | MA | AA | DTBP | Mw | Mn | Main peak | High = molecular side peak | Acid value (mg · KOH/g) | Tg (° C.) |
| | | (parts by weight) | | | | | | | | | | |
| B-1 | A-1 30.0 | 56.5 | 12.8 | 0.7 | — | 1.4 | 94,000 | 7,000 | 13,500 | 250,000 | 8.5 | 58.1 |
| B-2 | A-2 30.0 | 55.8 | 11.6 | 2.6 | — | 1.1 | 120,000 | 9,600 | 17,000 | 380,000 | 26.3 | 59.1 |
| B-3 | A-3 30.0 | 55.6 | 14.2 | — | 0.2 | 1.7 | 85,000 | 6,000 | 8,000 | 160,000 | 2.7 | 56.2 |
| B-4 | A-2 70.0 | 21.5 | 5.8 | 2.7 | — | 0.7 | 280,000 | 12,000 | 20,000 | 390,000 | 40.1 | 56.0 |

TABLE 4-continued

Physical Properties of Vinyl Resin Having Carboxyl Group

| Resin: | Formulation: High = molecular weight component | St (parts by weight) | BA | MA | AA | DTBP | GPC: Mw | Mn | Main peak | High = molecular side peak | Acid value (mg · KOH/g) | Tg (° C.) |
|---|---|---|---|---|---|---|---|---|---|---|---|---|
| B-5 | A-3 10.0 | 71.3 | 28.6 | — | 0.1 | 4.5 | 41,000 | 5,100 | 5,500 | 100,000 | 3.5 | 55.8 |
| B-6 | A-4 50.0 | 40.0 | 10.0 | — | — | 1.0 | 130,000 | 7,000 | 12,000 | 290,000 | 0.0 | 61.5 |

St: Styrene;
BA: n-Butyl acrylate;
MA: Methacrylic acid;
AA: Acrylic acid
DTBP: Di-t-butyl peroxide

TABLE 5

Physical Properties of Vinyl Resin Having Epoxy Group

| Resin: | Formulation: St (parts by weight) | BA | GlyMA | DTBP | GPC: Mw | Mn | Epoxy value |
|---|---|---|---|---|---|---|---|
| C-1 | 76.2 | 18.0 | 5.6 | 5.0 | 7,900 | 6,300 | 0.5 |
| C-2 | 68.1 | 15.7 | 16.2 | 5.0 | 7,000 | 5,800 | 1.0 |
| C-3 | 76.0 | 21.2 | 2.8 | 5.0 | 6,400 | 5,100 | 0.2 |

St: Styrene;

BA: n-Butyl acrylate;

GlyMA: Glycidyl methacrylate;

DTBP: Di-t-butyl peroxide

TABLE 6

| Binder Resin: | Resin component B | Resin component C | B/C proportion | Reaction Conditions | THF-soluble matter GPC: Mw | Mn | Main peak | Acid value (mg · KOH/g) | THF-insoluble matter (wt. %) |
|---|---|---|---|---|---|---|---|---|---|
| 1 | B-1 | C-1 | 90/10 | i | 87,000 | 8,000 | 13,500 | 7.7 | 18 |
| 2 | B-1 | C-1 | 90/10 | ii | 85,000 | 8,100 | 14,000 | 7.9 | 19 |
| 3 | B-2 | C-2 | 90/10 | ii | 150,000 | 12,000 | 18,000 | 1.0 | 34 |
| 4 | B-3 | C-3 | 90/10 | ii | 55,000 | 6,000 | 9,500 | 35.8 | 7 |
| 5 | B-2 | C-2 | 90/10 | iii | 300,000 | 18,000 | 22,000 | 2.6 | 8 |
| 6 | B-4 | C-2 | 90/10 | ii | 320,000 | 19,000 | 24,000 | 2.1 | 43 |
| 7 | B-5 | C-3 | 90/10 | ii | 32,000 | 4,000 | 6,000 | 41.2 | 3 |
| 8 | B-4 | C-2 | 80/20 | ii | 450,000 | 26,000 | 38,000 | 1.4 | 53 |
| 9 | B-4 | — | 100/0 | ii | 130,000 | 7,000 | 12,000 | 0.0 | 0 |

TABLE 7

Measurement of ODCB-soluble matter absolute molecular weight

| | Toner | Resin | Wax (pbw) | Kneading conditions | Weight = average molecular weight | Main = peak molecular weight | Radius of inertia (nm) | Proportion of component with molecular weight of: 10k* or less (wt. %) | 1kk* or more (wt. %) | Intrinsic viscosity (ml/g) | ODCB = insoluble matter (wt. %) | Glass transition point (° C.) | Acid value (mg · KOH/g) |
|---|---|---|---|---|---|---|---|---|---|---|---|---|---|
| Example: | | | | | | | | | | | | | |
| 1 | 1 | 1 | a1(2), b1(5) | 1 | 16,460 | 7,200 | 5.4 | 61.3 | 0.0 | 0.44 | 7.0 | 54.0 | 8.0 |
| 2 | 2 | 2 | a1(2), b1(5) | 1 | 15,000 | 7,000 | 4.8 | 65.1 | 0.1 | 0.47 | 11.0 | 54.2 | 8.2 |
| 3 | 3 | 2 | a1(2), b1(5) | 2 | 14,000 | 6,800 | 3.1 | 70.3 | 0.1 | 0.48 | 13.0 | 54.4 | 8.1 |
| 4 | 4 | 3 | a1(2), b1(5) | 3 | 38,000 | 15,000 | 12.5 | 48.2 | 2.3 | 0.55 | 17.0 | 55.4 | 1.2 |
| 5 | 5 | 4 | a1(2), b1(2) | 3 | 10,200 | 5,800 | 2.9 | 80.2 | 0.0 | 0.19 | 0.4 | 53.2 | 30.4 |
| 6 | 6 | 5 | a1(2), b1(2) | 3 | 58,000 | 18,000 | 14.3 | 43.3 | 5.1 | 0.70 | 0.2 | 56.3 | 1.0 |
| Comparative Example: | | | | | | | | | | | | | |
| 1 | 7 | 6 | a1(2), b1(2) | 3 | 125,000 | 22,000 | 15.1 | 41.3 | 5.3 | 0.79 | 18.6 | 57.1 | 0.8 |
| 2 | 8 | 7 | a2(2), b3(5) | 3 | 6,000 | 4,200 | 2.1 | 91.2 | 0.0 | 0.15 | 0.2 | 52.8 | 42.1 |
| 3 | 9 | 8 | a3(2), b2(5) | 3 | 260,000 | 35,000 | 16.4 | 38.2 | 5.3 | 1.01 | 22.6 | 57.6 | 0.6 |
| 4 | 10 | 9 | a3(2), b2(5) | 3 | 520,000 | 36,000 | 17.4 | 72.1 | 10.2 | 1.78 | 0.0 | 60.4 | 0.0 |
| 5 | 11 | 9 | a3(2) | 3 | 530,000 | 35,000 | 17.4 | 72.3 | 10.3 | 2.06 | 0.0 | 60.5 | 0.0 |

*10k = 10,000; 1kk = 1,000,000

TABLE 8

Evaluation Results

| | Fixing performance (° C.) | Antioffset property (° C.) | Antiblocking property | Low-temperature/low-humidity environment: Negative ghost | Spots around line images | Image density: Initial stage | Image density: 18,000 sheets | Fog, initial stage | Fog on 18,000th sheet | High-temp./high-humidity environment Image density: Initial stage | High-temp./high-humidity environment Image density: 18,000 sheets |
|---|---|---|---|---|---|---|---|---|---|---|---|
| Example | | | | | | | | | | | |
| 1 | 140 | 250 | A | A | A | 1.51 | 1.50 | 0.3 | 0.4 | 1.54 | 1.53 |
| 2 | 145 | 250 | A | A | A | 1.50 | 1.48 | 0.4 | 0.4 | 1.51 | 1.50 |
| 3 | 145 | 245 | A | A | A | 1.50 | 1.46 | 0.5 | 0.6 | 1.50 | 1.49 |
| 4 | 150 | 245 | A | A | B | 1.50 | 1.46 | 0.5 | 0.6 | 1.49 | 1.46 |
| 5 | 145 | 235 | B | B | B | 1.46 | 1.42 | 0.8 | 1.0 | 1.45 | 1.32 |
| 6 | 155 | 240 | B | C | C | 1.45 | 1.34 | 1.3 | 1.5 | 1.41 | 1.34 |
| Comparative Example: | | | | | | | | | | | |
| 1 | 160 | 245 | B | C | C | 1.36 | 1.26 | 1.7 | 2.0 | 1.39 | 1.29 |
| 2 | 145 | 220 | E | C | D | 1.35 | 1.24 | 2.1 | 2.3 | 1.38 | 1.10 |
| 3 | 165 | 245 | C | D | C | 1.25 | 1.18 | 2.4 | 2.8 | 1.31 | 1.18 |
| 4 | 170 | 220 | D | D | D | 1.20 | 1.15 | 3.0 | 3.4 | 1.10 | 0.97 |
| 5 | 175 | 220 | D | D | D | 1.18 | 1.06 | 3.3 | 3.5 | 1.07 | 0.91 |

This application claims priority from Japanese Patent Application No. 2004-043956 filed Feb. 20, 2004, which is hereby incorporated by reference herein.

What is claimed is:

1. A toner comprising: toner particles containing at least a binder resin, a hydrocarbon wax (a), a hydrocarbon wax (b) and a colorant, wherein;

said binder resin contains a vinyl resin;

said hydrocarbon wax (a) has a hydroxyl value of less than 5 mg·KOH/g and an ester value of less than 1 mg·KOH/g;

said hydrocarbon wax (b) has a hydroxyl value Hv of 5 to 150 mg·KOH/g;

a weight average molecular weight (Mw) of absolute molecular weights measured with a viscosity detector in high-temperature GPC-RALLS-viscometer analysis of o-dichlorobenzene-soluble matter of said toner is from $1.0\times10^3$ to $1\times10^5$;

in said o-dichlorobenzene-soluble matter, a component having the absolute molecular weight of 10,000 or less is in a proportion of from 40% by weight to 90% by weight, and a component having the absolute molecular weight of 1,000,000 or more is less than 10% by weight; and said toner has an intrinsic viscosity of from 0.20 ml/g to 0.60 ml/g as measured with the viscosity detector.

2. The toner according to claim 1, wherein said vinyl resin is a styrene resin having as a primary constituent a unit derived from styrene.

3. The toner according to claim 1, which contains o-dichlorobenzene-insoluble matter in an amount of from 0.1% by weight to 20% by weight based on the weight of the resin component in the toner.

4. The toner according to claim 1, wherein said binder resin contains at least i) a vinyl resin having a carboxyl group and ii) a vinyl resin having as partial structure a linkage formed by reaction of a carboxyl group with an epoxy group.

5. The toner according to claim 1, wherein the hydrocarbon wax (a) has, in regard to an endothermic peak at the time of heating in a DSC curve obtained by measurement with a differential scanning calorimeter, an endothermic-peak leading temperature of 80° C. or more, an endothermic onset temperature of 105° C. or less, an endothermic main peak temperature in the range of from 100° C. to 120° C., and has a viscosity at 120° C. of 100 mPa·s or less.

6. The toner according to claim 5, wherein the hydrocarbon wax (b) has a viscosity at 120° C. of 80 mPa·s or less, in which an acid value ($Av_B$) of said binder resin and the hydroxyl value (Hv) of said hydrocarbon wax (b) satisfy the following expression:

$$0.05 \leqq Av_B/Hv \leqq 3.5.$$

7. The toner according to claim 6, wherein viscosity (ηa) of said hydrocarbon wax (a) at 120° C. and viscosity (ηb) of said hydrocarbon wax (b) at 120° C. have the following relationship:

$$\eta a > \eta b.$$

* * * * *

UNITED STATES PATENT AND TRADEMARK OFFICE

CERTIFICATE OF CORRECTION

PATENT NO. : 7,351,509 B2
APPLICATION NO. : 11/013534
DATED : April 1, 2008
INVENTOR(S) : Shuhei Moribe et al.

It is certified that error appears in the above-identified patent and that said Letters Patent is hereby corrected as shown below:

TITLE PAGE [75] INVENTORS:

Inventors, "Shuhei Moribe, Shizuoka (JP);
Nobuyuki Okubo, Shizuoka (JP);
Tsutomu Onuma, Kanagawa (JP);
Shinichiro Abe, Ibaraki (JP); Koki
Nishikawa, Shizuoka (JP)" should read
--Shuhei Moribe, Numazu (JP);
Nobuyuki Okubo, Numazu (JP);
Tsutomu Onuma, Yokohama (JP);
Shinichiro Abe, Toride (JP); Koji
Nishikawa, Shizuoka (JP)--.

COLUMN 4:

Line 16, "detector. (GPC-RALLS:" should read --detector. ¶ (GPC-RALLS:--.

COLUMN 10:

Line 43, "preferred" should read --referred--.

COLUMN 14:

Line 63, "115°C.)" should read --115°C.).--.

COLUMN 23:

Line 4, "$Y_1$ and $_{Y3}$" should read --$Y_1$ and $Y_3$--; and
Line 4, "$Y_1$ and $_{Y3}$" should read --$Y_1$ and $Y_3$--.

COLUMN 33:

Line 15, "$Rg=(l/6)^{1/2}$ ([θ]) $M_{90}/(\phi)^{1/3}$... Flory Fox equation."
should read --$Rg=(l/6)^{1/2}$ ([η]) $M_{90}/(\phi)^{1/3}$... Flory Fox equation.--.

COLUMN 38:

Line 13, (close up space); and
Line 14, "¶ Erlenmeyer" should read --Erlenmeyer--.

UNITED STATES PATENT AND TRADEMARK OFFICE

CERTIFICATE OF CORRECTION

PATENT NO. : 7,351,509 B2
APPLICATION NO. : 11/013534
DATED : April 1, 2008
INVENTOR(S) : Shuhei Moribe et al.

It is certified that error appears in the above-identified patent and that said Letters Patent is hereby corrected as shown below:

COLUMN 43:

Line 1, "extern-1" should read --external--.

Signed and Sealed this

Twenty-first Day of October, 2008

JON W. DUDAS
*Director of the United States Patent and Trademark Office*